US012752900B2

(12) United States Patent
Buchanan et al.

(10) Patent No.: US 12,752,900 B2
(45) Date of Patent: Oct. 6, 2026

(54) DETACHABLE CONTROL MODULE FOR A MARINE DEVICE

(71) Applicant: Navico Group Americas, LLC, Menomonee Falls, WI (US)

(72) Inventors: Spencer David Buchanan, Auckland (NZ); Paul Robert Bailey, Auckland (NZ); Aaron J. Burton, Jenks, OK (US); Samuel B. Carlisle, Caledonia, MI (US)

(73) Assignee: Navico Group Americas, LLC, Menomonee Falls, WI (US)

( * ) Notice: Subject to any disclaimer, the term of this patent is extended or adjusted under 35 U.S.C. 154(b) by 349 days.

(21) Appl. No.: 18/606,429

(22) Filed: Mar. 15, 2024

(65) Prior Publication Data

US 2025/0289555 A1 Sep. 18, 2025

(51) Int. Cl.
*B63H 21/21* (2006.01)
*B63H 20/00* (2006.01)

(52) U.S. Cl.
CPC ..... *B63H 21/213* (2013.01); *B63H 20/007* (2013.01); *B63H 21/21* (2013.01); *B63H 2021/216* (2013.01)

(58) Field of Classification Search
CPC ..... B63H 21/00; B63H 21/21; B63H 21/213; B63H 2021/216; B63H 20/00; B63H 20/007

(Continued)

(56) References Cited

U.S. PATENT DOCUMENTS 2,877,733 A 3/1959 Harris
3,598,947 A 8/1971 Osborn (Continued)

FOREIGN PATENT DOCUMENTS

EP 2 602 639 A1 6/2013
EP 1 891 461 B1 5/2014

(Continued)

OTHER PUBLICATIONS

"Minn Kota RIPTIDE ST Foot Pedal Accessory User Manual;" retrieved Dec. 7, 2017 from file:///C:/Users/PForbes/Downloads/2377123rc_RT_ST_Foot_Pedal_Manual.pdf.; 4 pages.

(Continued)

*Primary Examiner* — Lars A Olson
(74) *Attorney, Agent, or Firm* — Nelson Mullins Riley & Scarborough LLP

(57) ABSTRACT

A user input system for controlling operation of a marine device. The user input system having a foot pedal assembly and a detachable control module that can be removably attached to the foot pedal assembly or function independently. The foot pedal assembly and detachable control module are configured to detect user input on the foot pedal and control elements on the detachable control module and process the inputs into instructional signals transmitted electrically over wired or wireless connections to other marine devices to control operational functions of the corresponding marine device. Such a user input system provides a consolidated control of functionality or expanded control of functionality of marine devices from a single control module that can save space and allow a user to control various functions of a marine device at their current position on a watercraft.

20 Claims, 13 Drawing Sheets

(58) Field of Classification Search
USPC ..... 440/1
See application file for complete search history.

(56) References Cited

U.S. PATENT DOCUMENTS

| | | | |
|---|---|---|---|
| 3,807,345 | A | 4/1974 | Peterson |
| 4,824,408 | A | 4/1989 | Aertker et al. |
| 5,293,351 | A | 3/1994 | Noponen |
| 5,420,828 | A | 5/1995 | Geiger |
| 5,892,338 | A | 4/1999 | Moore et al. |
| 6,054,831 | A | 4/2000 | Moore et al. |
| 6,181,644 | B1 | 1/2001 | Gallagher |
| 6,325,684 | B1 | 12/2001 | Knight |
| 6,447,347 | B1 | 9/2002 | Steinhauser |
| 6,504,794 | B2 | 1/2003 | Haase et al. |
| 6,507,164 | B1 | 1/2003 | Healey et al. |
| 6,524,144 | B2 | 2/2003 | Pasley |
| 6,661,742 | B2 | 12/2003 | Hansen |
| 6,678,589 | B2 | 1/2004 | Robertson et al. |
| 6,868,360 | B1 | 3/2005 | Olstad et al. |
| 6,870,794 | B2 | 3/2005 | Healey |
| 6,902,446 | B1 | 6/2005 | Healey |
| 6,909,946 | B1 | 6/2005 | Kabel et al. |
| 6,919,704 | B1 | 7/2005 | Healey |
| 7,004,804 | B2 | 2/2006 | Bernloehr et al. |
| 7,190,636 | B1 | 3/2007 | Depaola |
| 7,195,526 | B2 | 3/2007 | Bernloehr et al. |
| 7,268,703 | B1 | 9/2007 | Kabel et al. |
| 7,303,595 | B1 | 12/2007 | Janitz |
| 7,371,218 | B2 | 5/2008 | Walston et al. |
| 7,430,461 | B1 | 9/2008 | Michaels |
| 7,452,251 | B2 | 11/2008 | Boebel |
| 7,538,511 | B2 | 5/2009 | Samek |
| D594,034 | S | 6/2009 | Bernloehr et al. |
| 7,542,376 | B1 | 6/2009 | Thompson et al. |
| 7,633,431 | B1 | 12/2009 | Wey et al. |
| 7,722,417 | B2 | 5/2010 | Bernloehr et al. |
| 8,106,617 | B1 | 1/2012 | Holley |
| 8,195,084 | B2 | 6/2012 | Xiao |
| 8,221,175 | B2 | 7/2012 | Mynster |
| 8,305,844 | B2 | 11/2012 | DePasqua |
| 8,645,012 | B2 | 2/2014 | Salmon et al. |
| 8,761,976 | B2 | 6/2014 | Salmon et al. |
| 8,814,129 | B2 | 8/2014 | Todd et al. |
| 8,879,359 | B2 | 11/2014 | DePasqua |
| 8,888,065 | B2 | 11/2014 | Logan |
| 8,896,480 | B1 | 11/2014 | Wilson et al. |
| 8,991,280 | B2 | 3/2015 | Wireman |
| 9,127,707 | B1 | 9/2015 | Huntley |
| 9,132,900 | B2 | 9/2015 | Salmon et al. |
| 9,135,731 | B2 | 9/2015 | Lauenstein et al. |
| 9,160,210 | B2 | 10/2015 | Perry |
| 9,162,743 | B1 | 10/2015 | Grace et al. |
| 9,201,142 | B2 | 12/2015 | Antao |
| 9,278,745 | B2 | 3/2016 | Kooi, Jr. et al. |
| 9,290,256 | B1 | 3/2016 | Wireman et al. |
| 9,296,455 | B2 | 3/2016 | Bernloehr et al. |
| 9,322,915 | B2 | 4/2016 | Betts et al. |
| 9,394,040 | B2 | 7/2016 | Grace et al. |
| 9,459,350 | B2 | 10/2016 | Betts et al. |
| 9,505,477 | B2 | 11/2016 | Grace et al. |
| 9,507,562 | B2 | 11/2016 | Bailey |
| 9,594,375 | B2 | 3/2017 | Jopling |
| 9,596,839 | B2 | 3/2017 | Bailey |
| 9,676,462 | B2 | 6/2017 | Bernloehr et al. |
| 9,746,874 | B2 | 8/2017 | Johnson et al. |
| 9,758,222 | B2 | 9/2017 | Grace et al. |
| 9,836,129 | B2 | 12/2017 | Clark |
| 10,025,312 | B2 | 7/2018 | Langford-Wood |
| 10,061,025 | B2 | 8/2018 | Kirmani |
| 10,114,119 | B2 | 10/2018 | Horner et al. |
| 10,114,470 | B2 | 10/2018 | Clark |
| 10,241,200 | B2 | 3/2019 | Sayer et al. |
| 10,247,823 | B2 | 4/2019 | Brown et al. |
| 10,311,715 | B2 | 6/2019 | Jopling |
| 10,324,175 | B2 | 6/2019 | Laster |
| 10,451,732 | B2 | 10/2019 | Laster |
| 10,460,484 | B2 | 10/2019 | Hovland et al. |
| 10,513,322 | B2 * | 12/2019 | Clark ..... B63H 21/21 |
| 11,703,866 | B2 | 7/2023 | Snyder et al. |
| 11,760,457 | B2 | 9/2023 | Pendergraft |
| 2003/0191562 | A1 | 10/2003 | Robertson et al. |
| 2003/0203684 | A1 | 10/2003 | Healey |
| 2003/0214483 | A1 | 11/2003 | Hammer et al. |
| 2005/0255761 | A1 | 11/2005 | Bernloehr et al. |
| 2006/0116031 | A1 | 6/2006 | Bernloehr et al. |
| 2009/0037040 | A1 | 2/2009 | Salmon et al. |
| 2009/0227158 | A1 | 9/2009 | Bernloehr et al. |
| 2012/0014220 | A1 | 1/2012 | DePasqua |
| 2012/0015566 | A1 | 1/2012 | Salmon |
| 2012/0060733 | A1 | 3/2012 | Maki et al. |
| 2012/0204467 | A1 | 8/2012 | Palmer et al. |
| 2012/0232719 | A1 | 9/2012 | Salmon et al. |
| 2012/0299764 | A1 | 11/2012 | Haneda et al. |
| 2013/0044569 | A1 | 2/2013 | DePasqua |
| 2013/0215719 | A1 | 8/2013 | Betts et al. |
| 2014/0203162 | A1 | 7/2014 | Logan |
| 2014/0249698 | A1 | 9/2014 | Salmon et al. |
| 2014/0269164 | A1 | 9/2014 | Betts et al. |
| 2014/0277851 | A1 | 9/2014 | Grace et al. |
| 2014/0336854 | A1 | 11/2014 | Salmon et al. |
| 2015/0016130 | A1 | 1/2015 | Davis et al. |
| 2015/0063059 | A1 | 3/2015 | DePasqua |
| 2015/0063060 | A1 | 3/2015 | DePasqua |
| 2015/0151824 | A1 | 6/2015 | Wireman |
| 2015/0346729 | A1 | 12/2015 | Grace et al. |
| 2016/0016651 | A1 | 1/2016 | Anderson et al. |
| 2016/0253150 | A1 | 9/2016 | Williams et al. |
| 2017/0038460 | A1 | 2/2017 | Clark |
| 2017/0285167 | A1 | 10/2017 | Proctor et al. |
| 2017/0371039 | A1 | 12/2017 | Clark et al. |
| 2018/0244361 | A1 | 8/2018 | Laster |
| 2018/0288990 | A1 | 10/2018 | Laster et al. |
| 2018/0329056 | A1 | 11/2018 | Smith et al. |
| 2018/0365246 | A1 | 12/2018 | Laster et al. |
| 2019/0072951 | A1 | 3/2019 | Clark et al. |
| 2019/0176952 | A1 | 6/2019 | Clark et al. |
| 2019/0176953 | A1 | 6/2019 | Clark et al. |
| 2019/0331779 | A1 | 10/2019 | Sandretto |
| 2020/0070943 | A1 | 3/2020 | Clark et al. |
| 2020/0272152 | A1 | 8/2020 | Combs |
| 2021/0037107 | A1 | 2/2021 | Klenk et al. |
| 2021/0056944 | A1 | 2/2021 | Vance |
| 2021/0371074 | A1 | 12/2021 | Lammers-Meis |
| 2022/0373662 | A1 | 11/2022 | Crawford et al. |
| 2023/0011068 | A1 | 1/2023 | Pendergraft |

FOREIGN PATENT DOCUMENTS

| | | | |
|---|---|---|---|
| EP | 3663888 | A1 | 6/2020 |
| GB | 2 421 312 | A | 6/2006 |
| WO | WO-95/28682 | A1 | 10/1995 |
| WO | WO-2013/126761 | A1 | 8/2013 |
| WO | WO-2014/144471 | A1 | 9/2014 |

OTHER PUBLICATIONS

Smolan et al; "The Click Effect;" New York Times VR; retrieved Feb. 13, 2020 from https://www.with.in/watch/CnVHWFg.

Porathe; "3-D Nautical Charts and Safe Navigation;" Department of Innovation, Design and Product Development; Doctoral Dissertation No. 27, Mälardalen University; Jan. 1, 2006; pp. 1-307.

Jun. 16, 2014 Search Report and Written Opinion issued in International Patent Application No. PCT/US2014/021133.

"Motor Guide Xi5 Wireless Foot Pedal;" retrieved Dec. 7, 2017 from http://www.motorguide.com/store/accessory/xi5-wireless-foot-pedal0.

"Magic Leap Quick Start Guide;" 2018; retrieved Feb. 13, 2020 from https://assets.ctfassets.net/b173eiperqoo/4H4PJgU9C0GySyie4QeuWE/c7ef230a10147e86173dd9250ce5.

(56) References Cited

OTHER PUBLICATIONS

Cornfield Crappie Gear; retrieved Jul. 19, 2021 from <https://www.cornfieldcrappiegear.com/>.

* cited by examiner

DETACHABLE CONTROL MODULE FOR A MARINE DEVICE

FIELD OF THE INVENTION

Embodiments of the present invention relate generally to controlling operation of a marine device and, more particularly, to a detachable control module for controlling functionality of trolling motors, sonar systems, or other marine devices.

BACKGROUND OF THE INVENTION

Marine devices such as trolling motors, sonar assemblies, propulsors, marine electronic devices, marine navigation systems, radar systems, marine radios, boat lighting, fighting equipment controllers, marine security systems, anchor systems, autopilot systems, and marine power supplies are commonly used on watercrafts for various marine activities and applications. These devices are typically controlled by a user through a control interface. However, the control interface for these devices can be complex and difficult to use and/or may be fixed in a location that is currently inconvenient. Furthermore, the control interface is often fixed and does not allow for customization or adjustments based on the user's preferences or needs. This can lead to inefficiencies and difficulties in controlling the marine devices, which can negatively impact the user's experience and performance of the marine devices. Conventional control over the operation of various marine devices onboard a watercraft may be difficult during fishing or other boating activities. For example, it may be inconvenient, distracting, or nonintuitive to reach and/or manipulate a marine trolling motor (e.g., attached at the front of the watercraft). Additionally, the visibility of mounted marine displays may be affected by the environment (e.g., weather, lighting, sunlight). Sometimes, a user may not have hands free in order operate a marine device (e.g., to press buttons and/or operate a touchscreen display). For example, a user may need to maintain hand control of a steering wheel, fishing rod, trolling motor, etc., which may make it difficult to otherwise operate marine equipment using conventional button or touch screen-based user input.

Moreover, obstacles—such as motion of the boat and various materials coating fingers (e.g., oils, sunscreen, fish, water, gloves, etc.)—may interfere with current interactions with marine electronics that require touch (e.g., touchscreen displays, graphical user interfaces, buttons, switches, keys, etc.) making them harder to control.

Further innovation with respect to controlling operation of a marine device is desirable. Accordingly, various systems and methods detailed herein improve operational control of marine devices onboard watercrafts.

BRIEF SUMMARY OF THE INVENTION

Example embodiments of the present invention provide systems and methods for optimizing control over marine devices onboard a watercraft. According to the example embodiments, a system including a trolling motor assembly, a sonar assembly, and other marine devices is provided for simplified operations.

As an operator or user of the watercraft equipped with a marine device such as a trolling motor, the operator or user may wish to remotely operate the trolling motor (e.g., not have to be positioned directly adjacent the trolling motor and/or have "hands free" control thereof). In this regard, the user may want to utilize a user input system such as a foot pedal assembly granting convenient hands-free interface for controls such as motorized power or speed adjustments. However, existing foot pedal assemblies offer limited control functions to the trolling motor (e.g., a fixed number of buttons or other user inputs). Embodiments of the present invention seek to provide foot pedal assemblies and other marine devices with additional operational control capabilities. The present invention puts forth a detachable control module which can, for an example, removably attach to the foot pedal assembly and, through a wired or wireless connection, allow further operational controls to any network connected marine device (e.g., the trolling motor, a sonar assembly, or any other marine device). For example, the user input options on the detachable control module may provide directional control of the trolling motor (or another orientable marine device), turning the trolling motor (or other marine device) on/off, or can be programmable to control other functions of the trolling motor or other marine device. Along these lines, the detachable control module may communicate with conventional sonar assembly that, in response to user activity, electronically controls the direction in which a transducer assembly of the sonar assembly is directed with respect to the watercraft. In this manner, a user is able to direct the "picture" (or image) of the underwater environment to the desired location relative to the watercraft. As indicated herein, the detachable control module may communicate with other marine devices that, in response to user activity, are electronically controlled.

In some embodiments, the detachable control module may removably attach to one or more marine devices, such as at the back of a foot pedal assembly (although other marine devices are contemplated, such as a trolling motor mount, or other part of the watercraft). With reference to attachment to the foot pedal assembly, notably, many foot pedal assemblies are sized to fit within a footwell of a watercraft. However, that limits the number of user input options for a user that wants to utilize such a foot pedal assembly (which is often a preferred "proportional feel" type of foot pedal-providing feedback that is proportional to the amount of rotation of a user's foot). Some anglers indeed utilize such a foot pedal assembly, but want access to more user input options (e.g., control elements). Accordingly, some embodiments of the present invention provide an optional detachable control module that can be used with such foot pedal assemblies—e.g., by attaching to the back of the foot pedal assembly and, in some embodiments, connecting to the processor of the foot pedal assembly to enable instruction signals to be sent therefrom. Notably, in some embodiments, the processor, power supply and/or other components can be housed within the detachable control module, such as to provide a stand-alone control device. Such a stand-alone control device may still be removably attachable to various marine devices, such as to provide modular control device that physically attaches somewhere on the watercraft.

In an example embodiment, a user input system is provided for controlling operations of a marine device. The user input system comprises a foot pedal assembly for controlling one or more operations of at least one of a trolling motor assembly or a sonar assembly, wherein the trolling motor assembly comprises a trolling motor and the sonar assembly comprises a sonar transducer assembly. The foot pedal assembly further comprises a base portion and a top portion, wherein the top portion is rotatable with respect to the base portion to enable a user to provide user input for steering a facing direction of the trolling motor or the sonar transducer assembly, wherein the top portion defines a top surface that is configured to receive the user's foot thereon. A detachable control module is configured to removably attach to the base portion of the foot pedal assembly for controlling operation of the marine device, wherein the marine device may comprise one of the trolling motor assembly, sonar assembly, a propulsor, a marine electronic device, a marine navigation system, a radar system, a marine radio, boat lighting, a fishing equipment controller, a marine security system, an anchor system, an autopilot system, or a marine power supply. The detachable control module comprises a module housing having a plurality of control elements disposed thereon, wherein the control elements provide additional control over functionality of the marine device through instruction signals sent over an established wired or wireless connection. Additionally, the detachable control module comprises one or more attachment features disposed on the module housing to removably attach the detachable control module to corresponding one or more foot pedal attachment features on the base portion. The detachable control module further comprises a processor configured to receive, based on user input being provided to one of the control elements, a signal indicative of the user input. The processor further determines, based on at least one of the user input or the plurality of control elements to which the user input was provided, a corresponding marine device and a corresponding instruction signal to send to the corresponding marine device. The processor further causes transmission of the instruction signal to the corresponding marine device via the wired or wireless connection to cause the operational control of the corresponding marine device.

In some embodiments, the base portion of the foot pedal assembly of the user input system may comprise a front and an opposing back, wherein the one or more foot pedal attachment features are positioned on or near the back of the base portion of the foot pedal assembly such that the detachable control module removably attaches to the back of the base portion.

In some embodiments, the user input system may comprise a cable that extends from the module housing of the detachable control module configured to electrically connect to an interface of the base portion of the foot pedal assembly to establish a module-to-foot pedal assembly wired connection that allows transmission of instruction signals to the foot pedal assembly.

In some embodiments, the foot pedal assembly of the user input system, may further provide power to the detachable control module via the module-to-foot pedal assembly wired connection.

In some embodiments, the foot pedal assembly of the user input system may comprise a wireless communication module that establishes a wireless communication interface. Additionally, the processor of the detachable control module may be positioned within the detachable control module wherein the processor is configured to wirelessly transmit the instruction signals to the wireless communication module of the foot pedal assembly and establish communication to the corresponding marine device.

In some embodiments, the plurality of control elements of the user input system may comprise a first control element and second control element wherein the first control element is positioned proximate a left side of the detachable control module and the second control element is positioned proximate a right side of the detachable control module. Pressing the first control element may cause the processor of the detachable control module to transmit instruction signals to a marine device such as the trolling motor assembly to steer the trolling motor of the trolling motor assembly in a leftward direction, wherein pressing the second control element causes the processor of the detachable control module to transmit instruction signals to the trolling motor assembly to steer the trolling motor of the trolling motor assembly in a rightward direction.

In some embodiments, the plurality of control elements of the user input system may further be configurable wherein pressing the first control element may cause the processor of the detachable control module to transmit instruction signals to a marine device such as the sonar assembly to adjust a beam-direction angle of the sonar transducer assembly in a leftward direction, wherein pressing the second control element causes the processor of the detachable control module to transmit instruction signals to the sonar assembly to adjust a beam-direction angle of the sonar transducer assembly in a rightward direction.

In some embodiments, the plurality of control elements of the user input system may comprise at least two buttons positioned on the module housing and facing upwardly.

In some embodiments, the at least two buttons may further be user-programmable to customize control over functionality related to the marine device.

In some embodiments, the at least two user-programmable buttons may further comprise a removable label positioned on the respective user-programmable button surface, wherein the removable label provides an indication of assigned functionality for the corresponding button.

In another example embodiment, a system is provided. The system includes a detachable control module for controlling operation of a marine device. The detachable control module comprises a module housing, a top portion defining a top surface, a plurality of control elements disposed on the top surface of the module housing wherein the plurality of control elements provide additional control over functionality of the marine device through instruction signals sent over an established wired or wireless connection. The detachable control module further comprises one or more attachment features disposed on the module housing to removably attach the detachable control module. Further, the detachable control module comprises a processor. The processor is configured to receive, based on user input being provided to one of the control elements, a signal indicative of the user input. The processor further determines, based on at least one of the user input or the plurality of control elements to which the user input was provided, a corresponding marine device and a corresponding instruction signal to send to the corresponding marine device. The processor further causes transmission of the instruction signal to the corresponding marine device via the wired or wireless connection to cause the operational control of the corresponding marine device.

In some embodiments, the detachable control module further comprises a rechargeable battery disposed within the module housing to provide an independent power source to the detachable control module.

In some embodiments, the one or more attachment features of the detachable control module may enable removable attachment of the detachable control module onto a marine device such as an existing trolling motor mounting assembly to provide additional user control input capabilities.

In some embodiments, the plurality of control elements of the detachable control module may comprise at least two buttons positioned on the top surface of module housing and facing upwardly.

In some embodiments, the at least two buttons may further be user-programmable to customize control over functionality related to the marine device.

In some embodiments, the at least two user-programmable buttons may further comprise a removable label positioned on the respective user-programmable button surface, wherein the removable label provides an indication of assigned functionality for the corresponding button.

In some embodiments, the processor of the detachable control module may further be configurable to interface with any marine device or system capable of receiving instruction signals and initiating instructed operations.

In another example embodiment, a method for controlling operation of a marine device with a detachable control module is provided. The method comprises detecting user input provided to at least one of a plurality of control elements of the detachable control module, wherein the user input indicates a desire of the user to control operation of the marine device. The detachable control module comprises one or more attachment features disposed on a module housing of the detachable control module to removably attach the detachable control module. The method further includes determining intended operation instructions based on the detected user input and generating, by a processor in communication with the plurality of control elements, instruction signals containing operational instructions for the marine device based on the determined user input. The method further includes transmitting the generated instruction signal to the associated marine device via a wired or wireless connection between the detachable control module and the marine device and controlling functionality of the marine device by the executed selected operations based on the transmitted instruction signal for the marine device.

In some embodiments, the plurality of control elements of the method may comprise at least two buttons that are user-programmable to customize control over functionality related to the marine device.

In some embodiments, the at least two user-programmable buttons may further comprise a removable label positioned on the respective user-programmable button surface, wherein the removable label provides an indication of assigned functionality for the corresponding button.

BRIEF DESCRIPTION OF THE DRAWINGS

Figure 1:
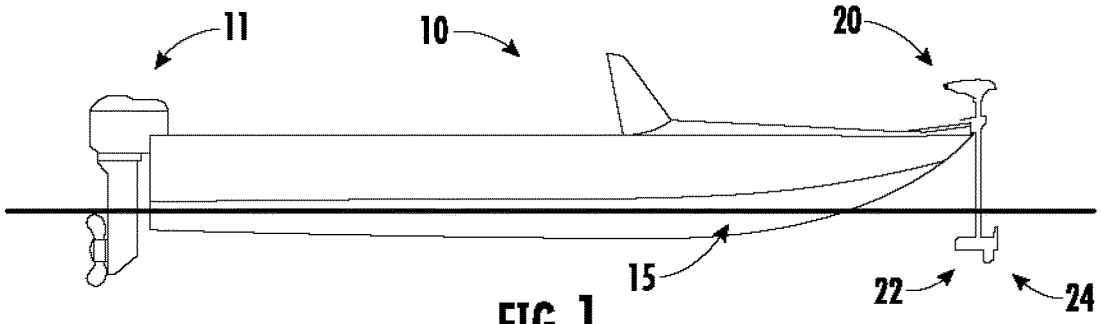
Figure 2A:
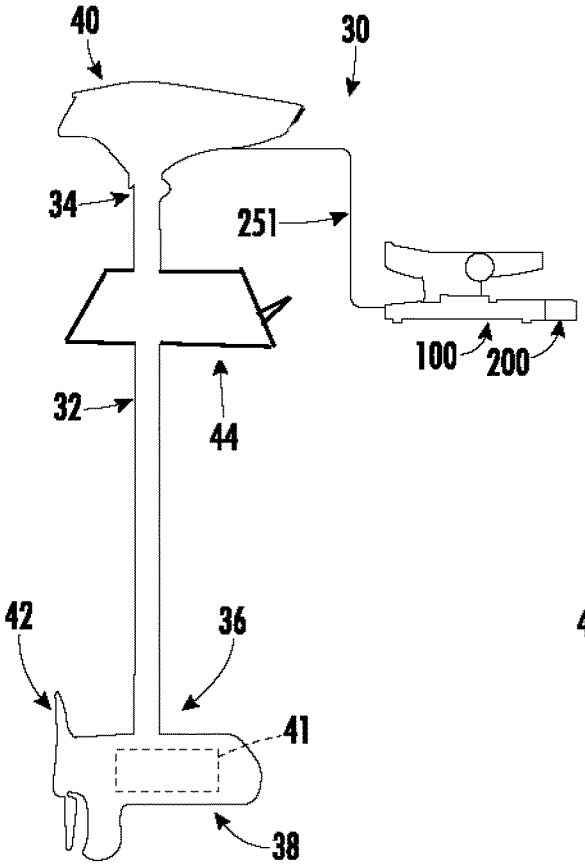
Figure 2B:
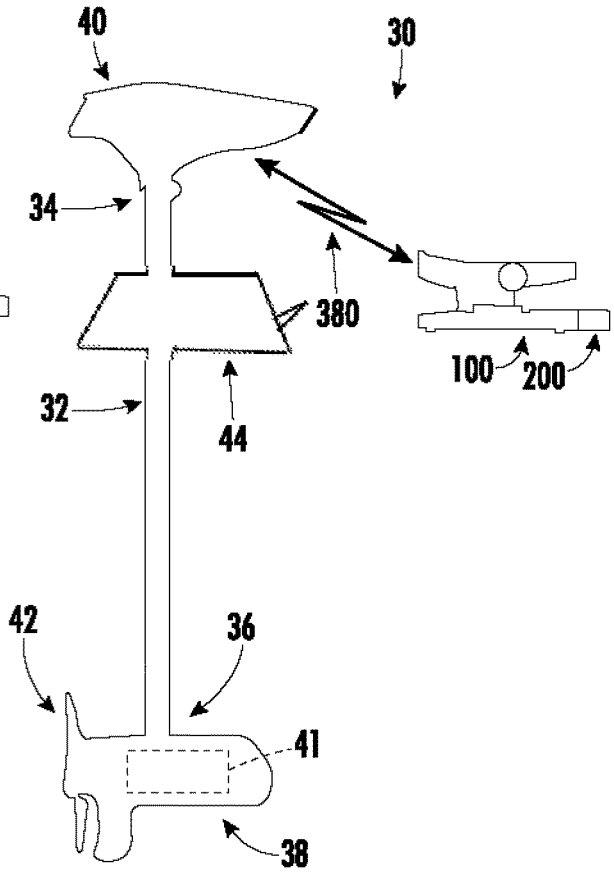
Figure 3:
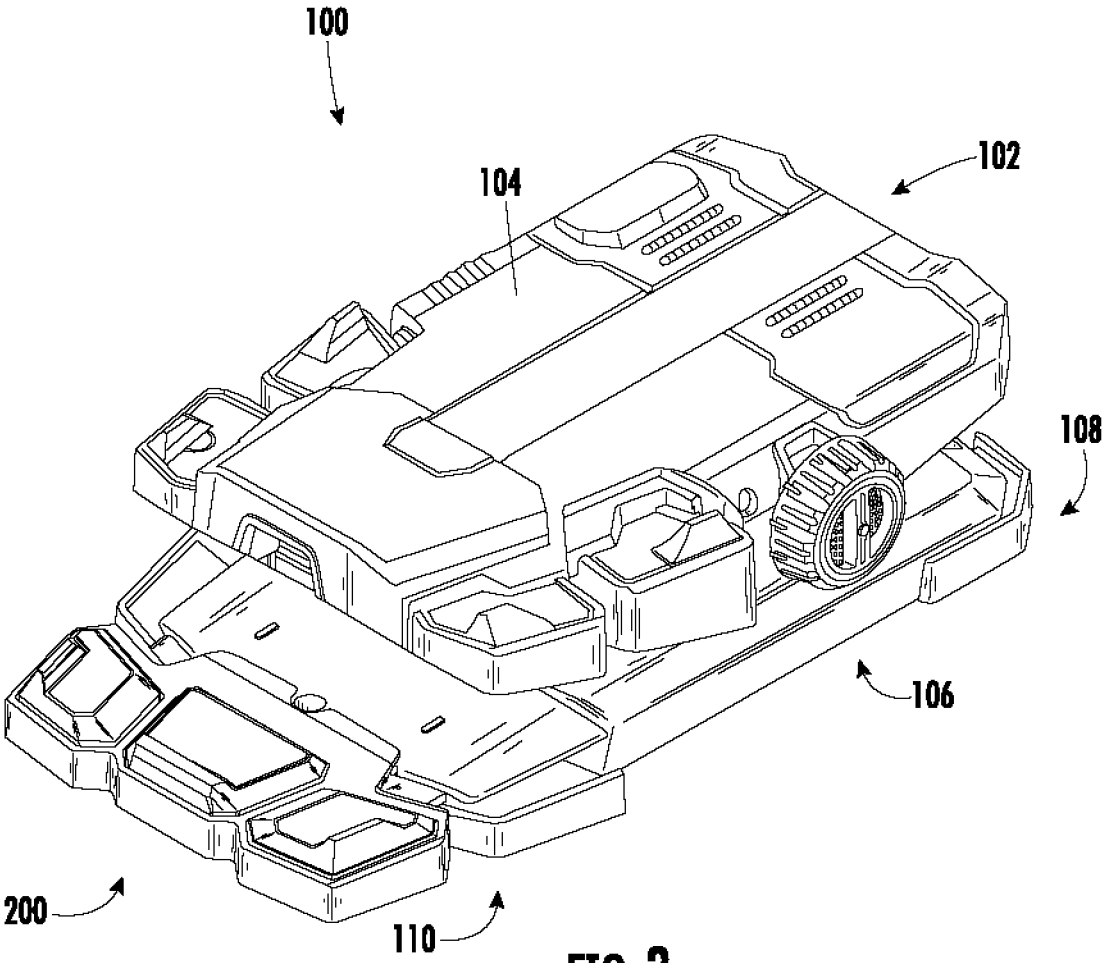
Figure 4:
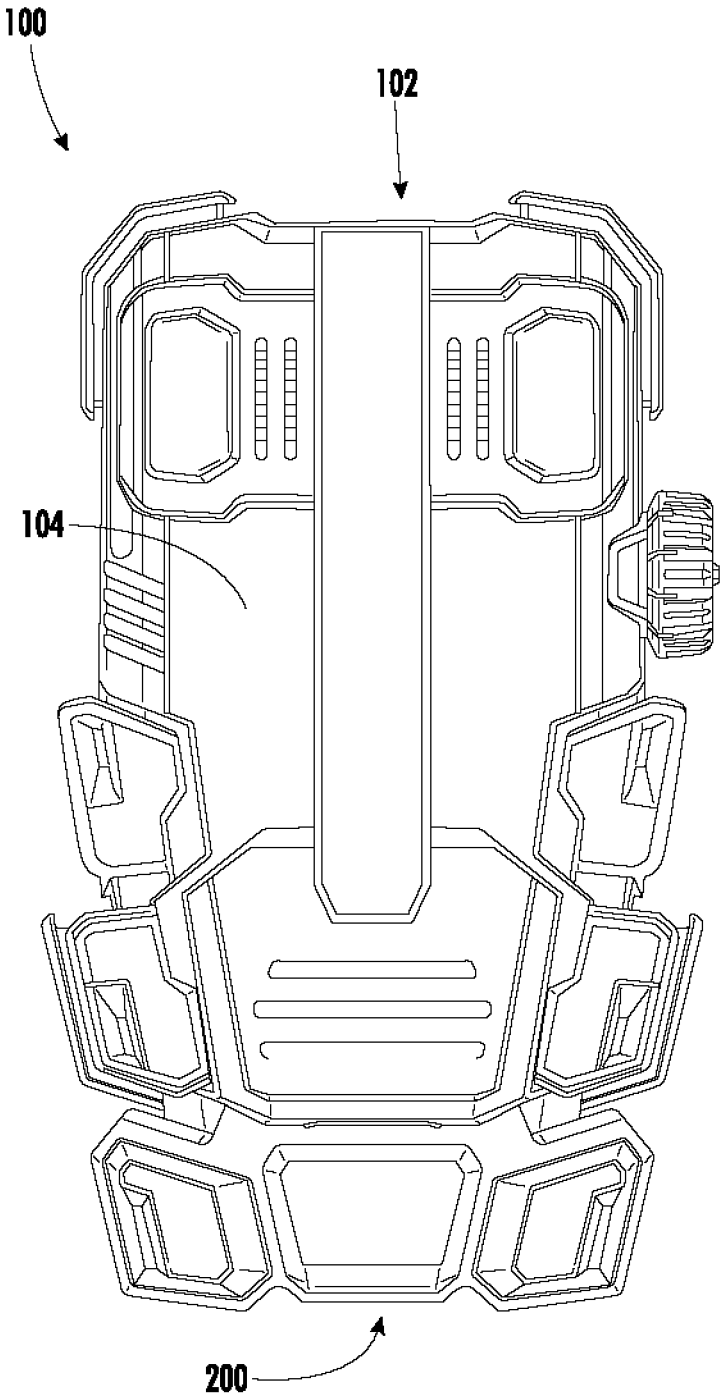
Figure 5:
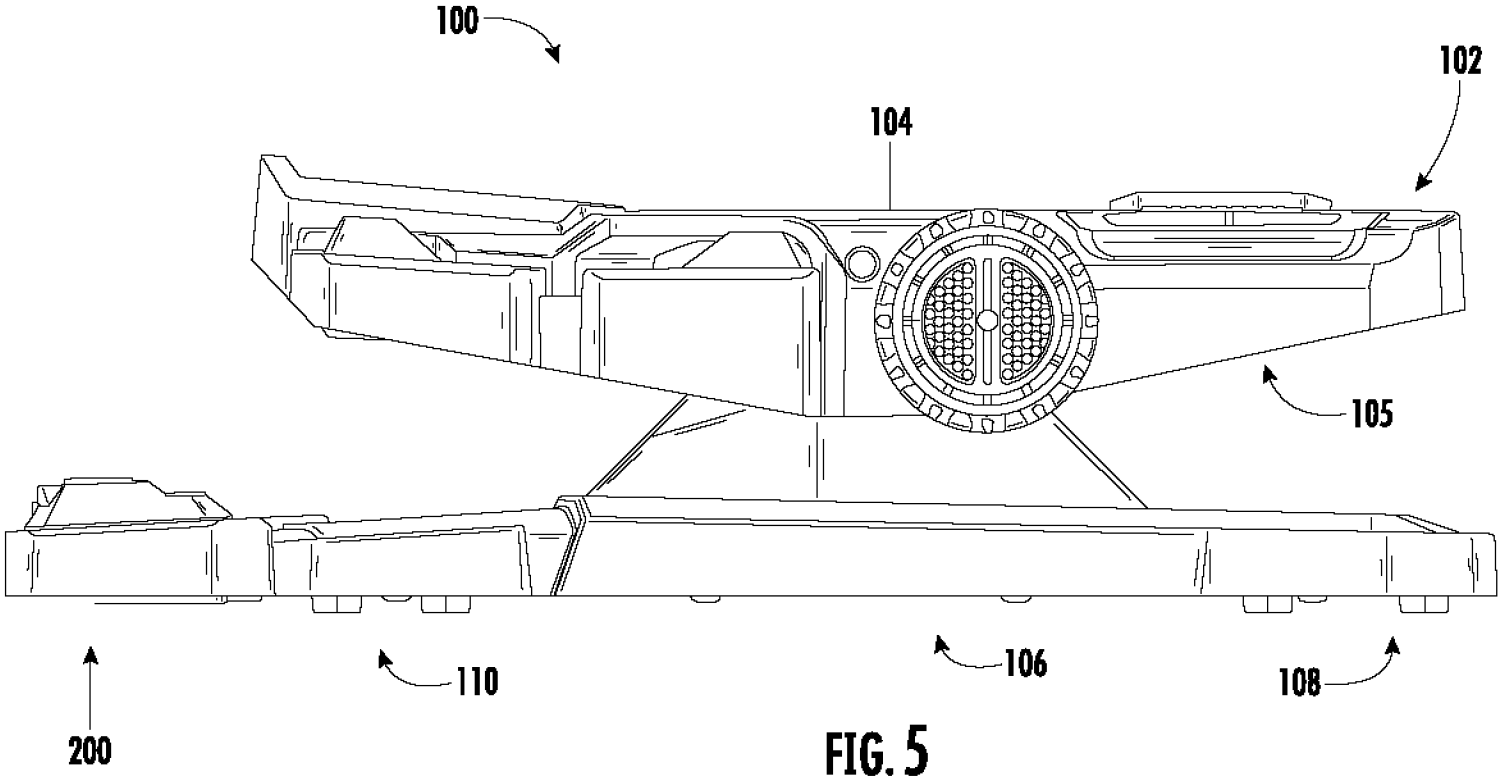
Figure 6:
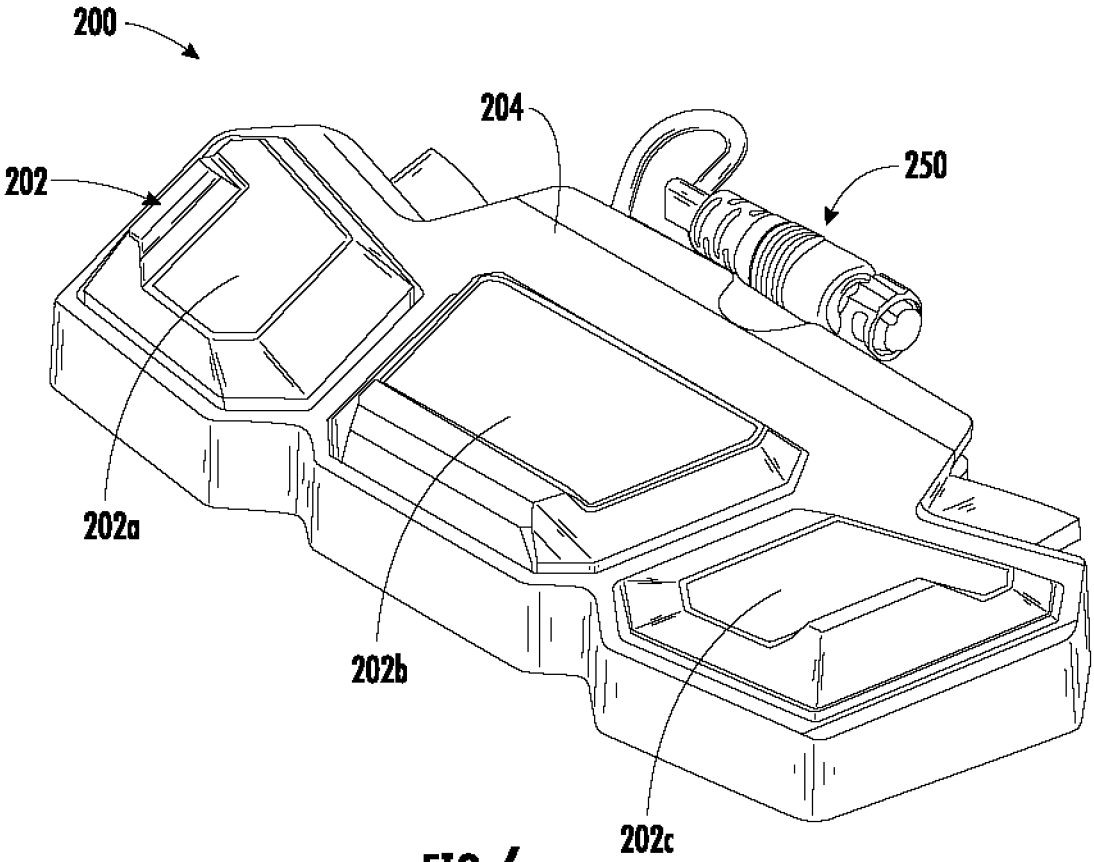
Figure 7:
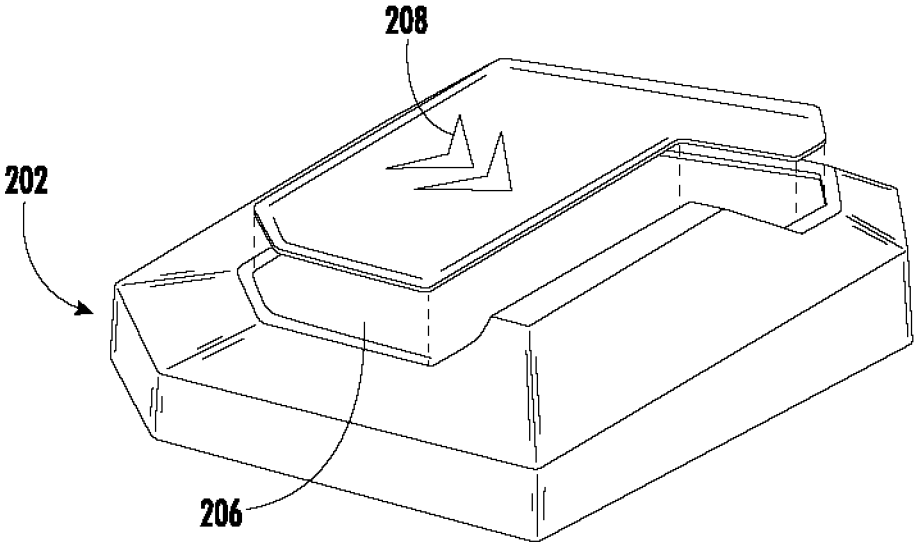
Figure 8:
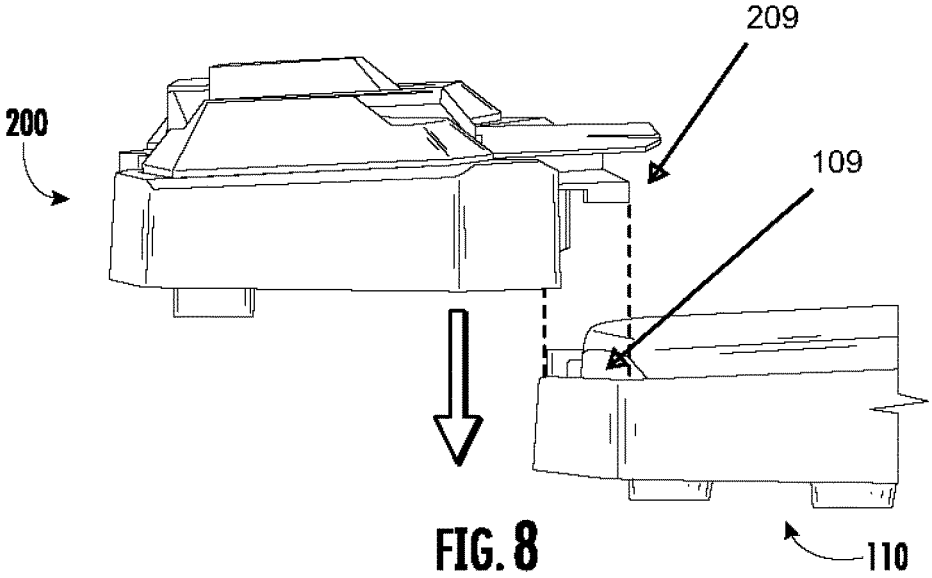
Figure 9:
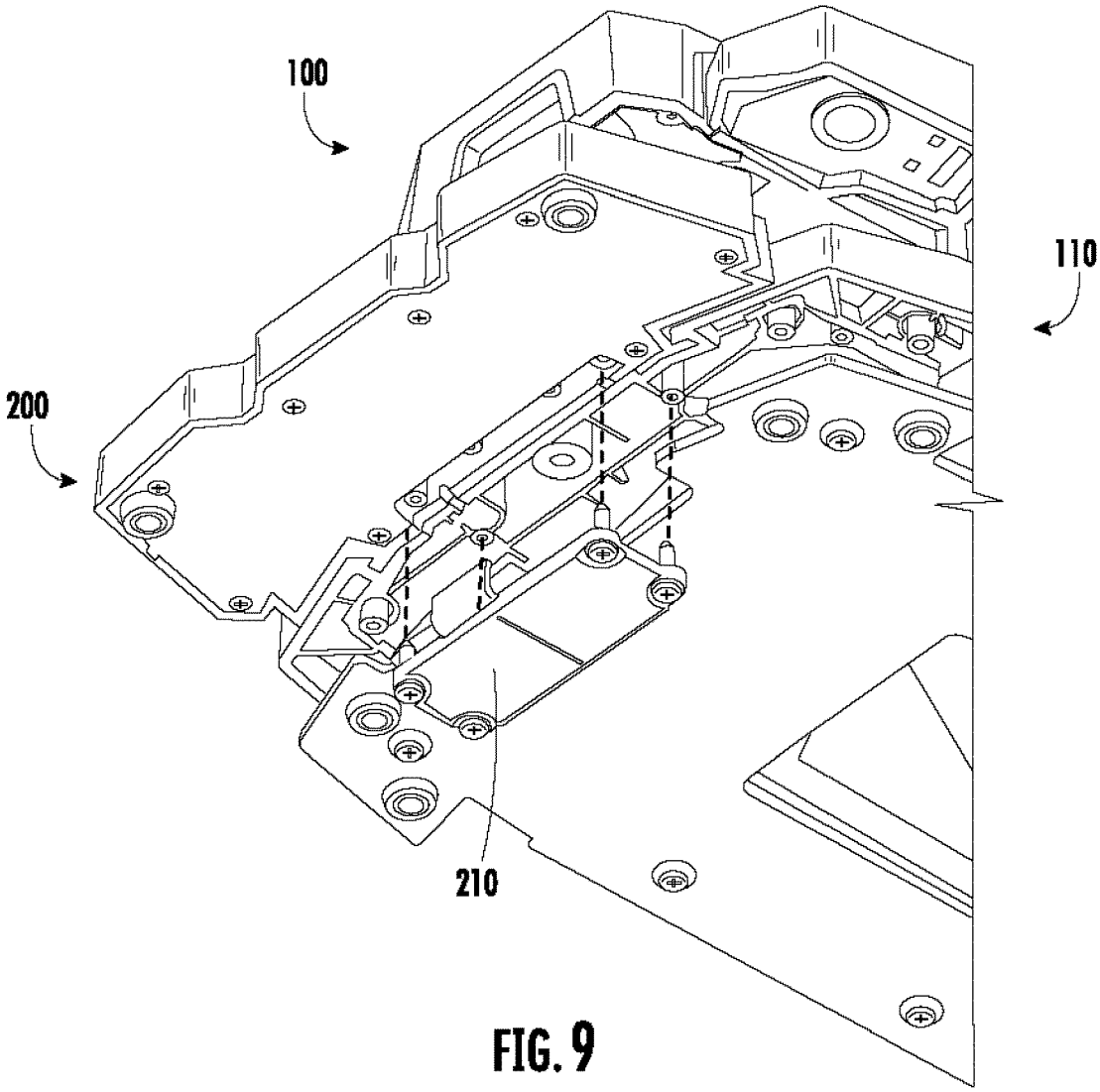
Figure 10:
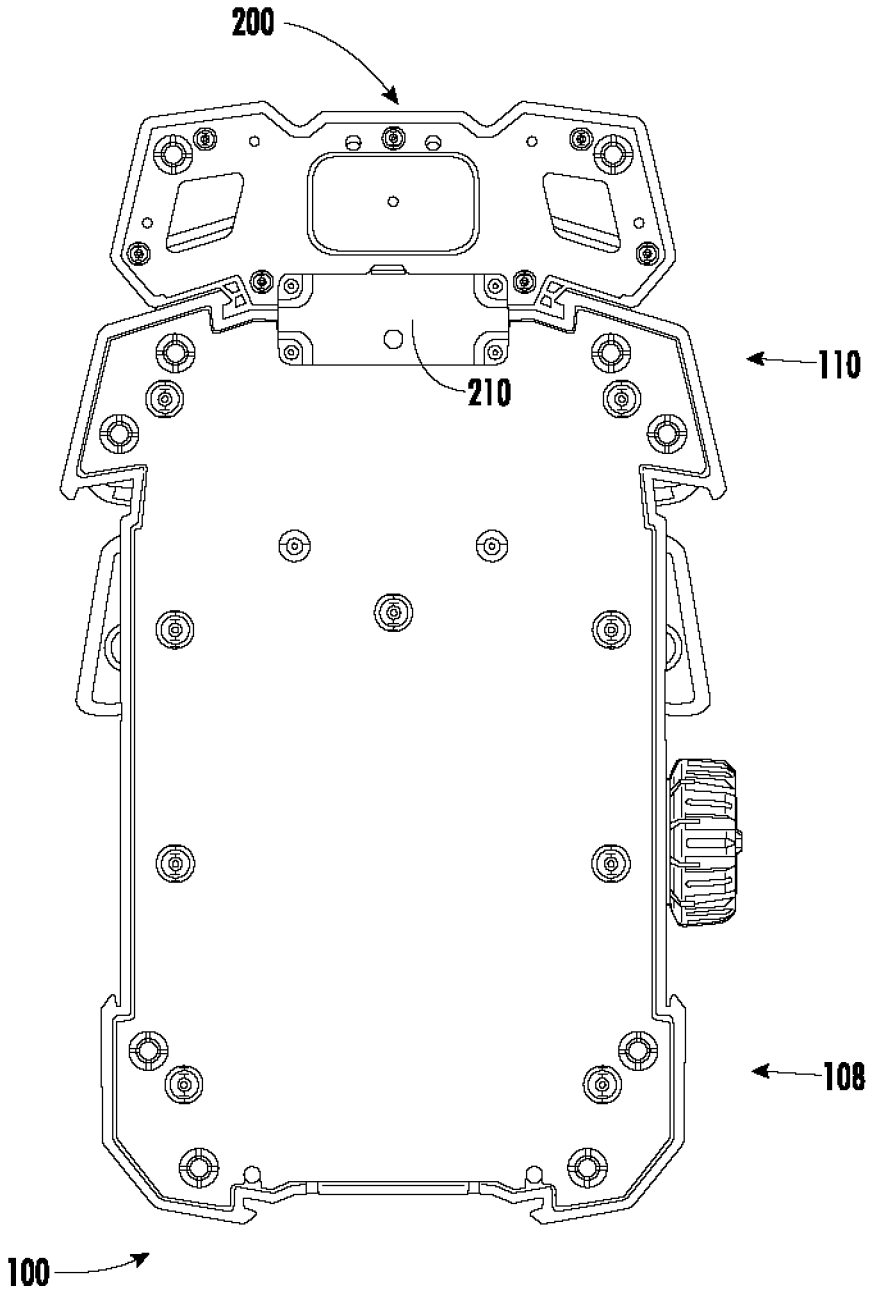
Figure 11:
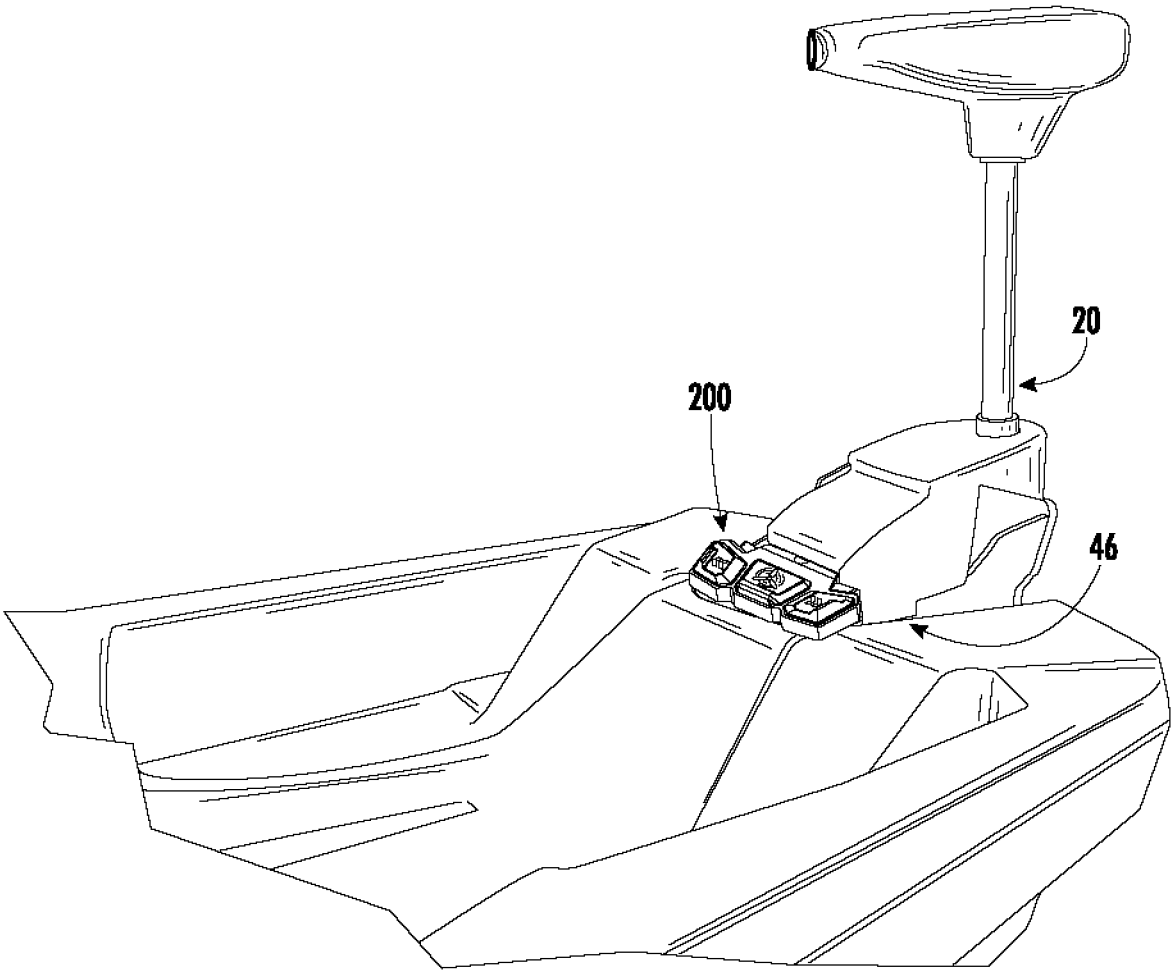
Figures 12A, 12B:
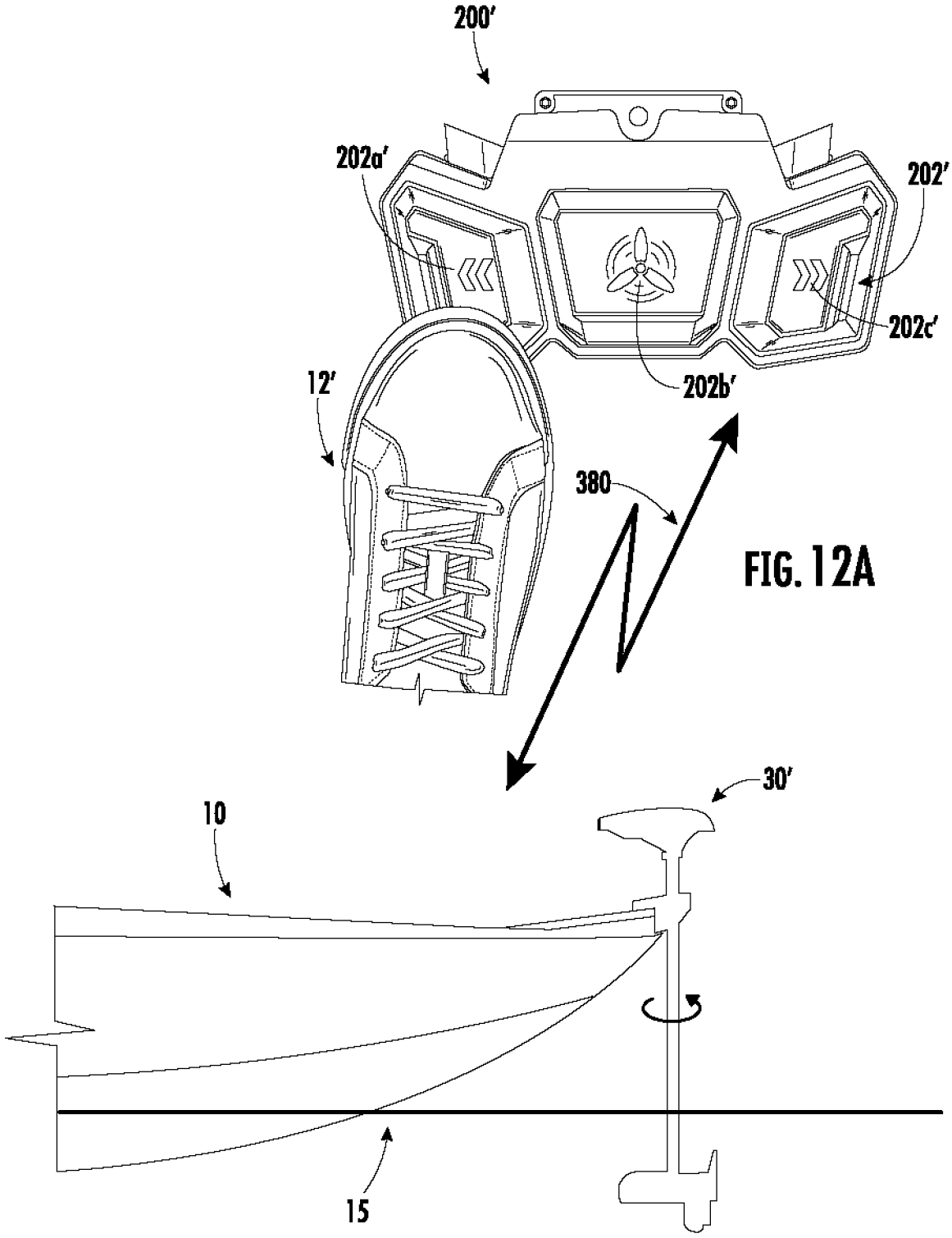
Figure 13A:
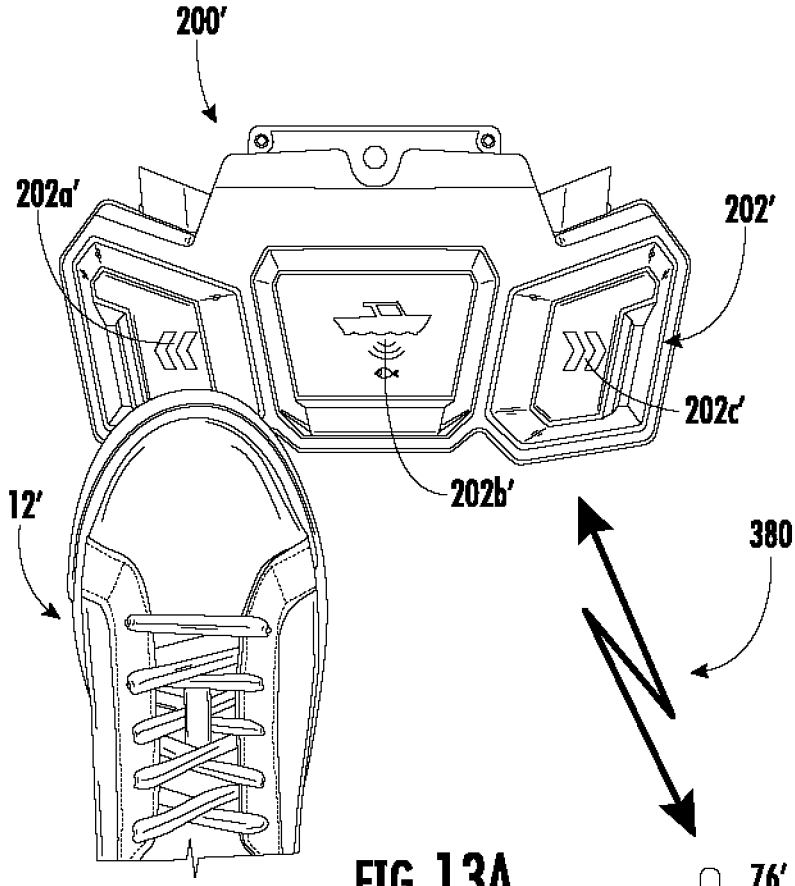
Figure 13B:
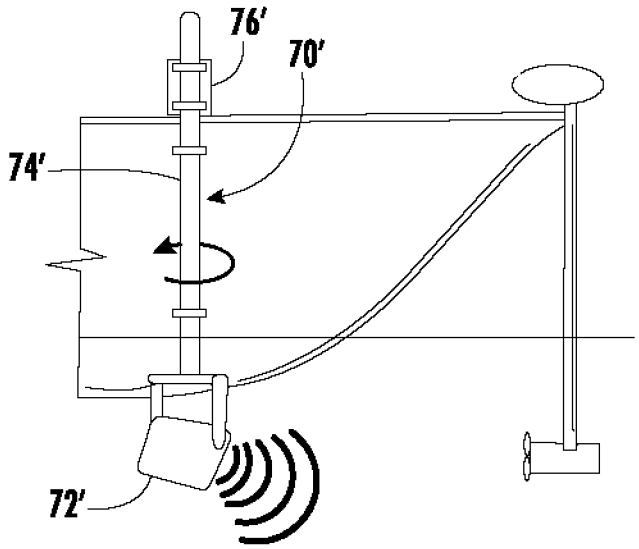
Figure 14:
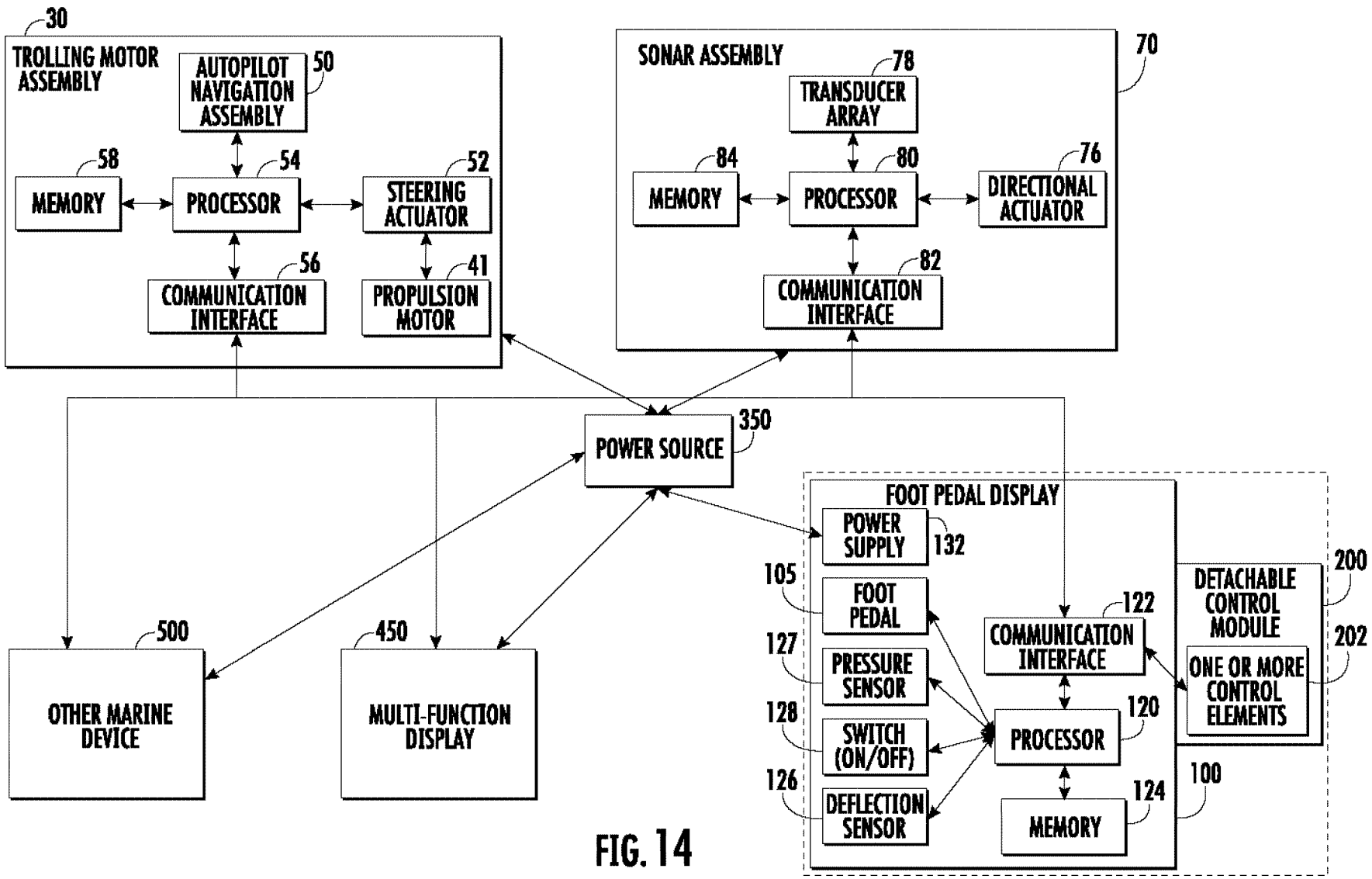
Figure 15:
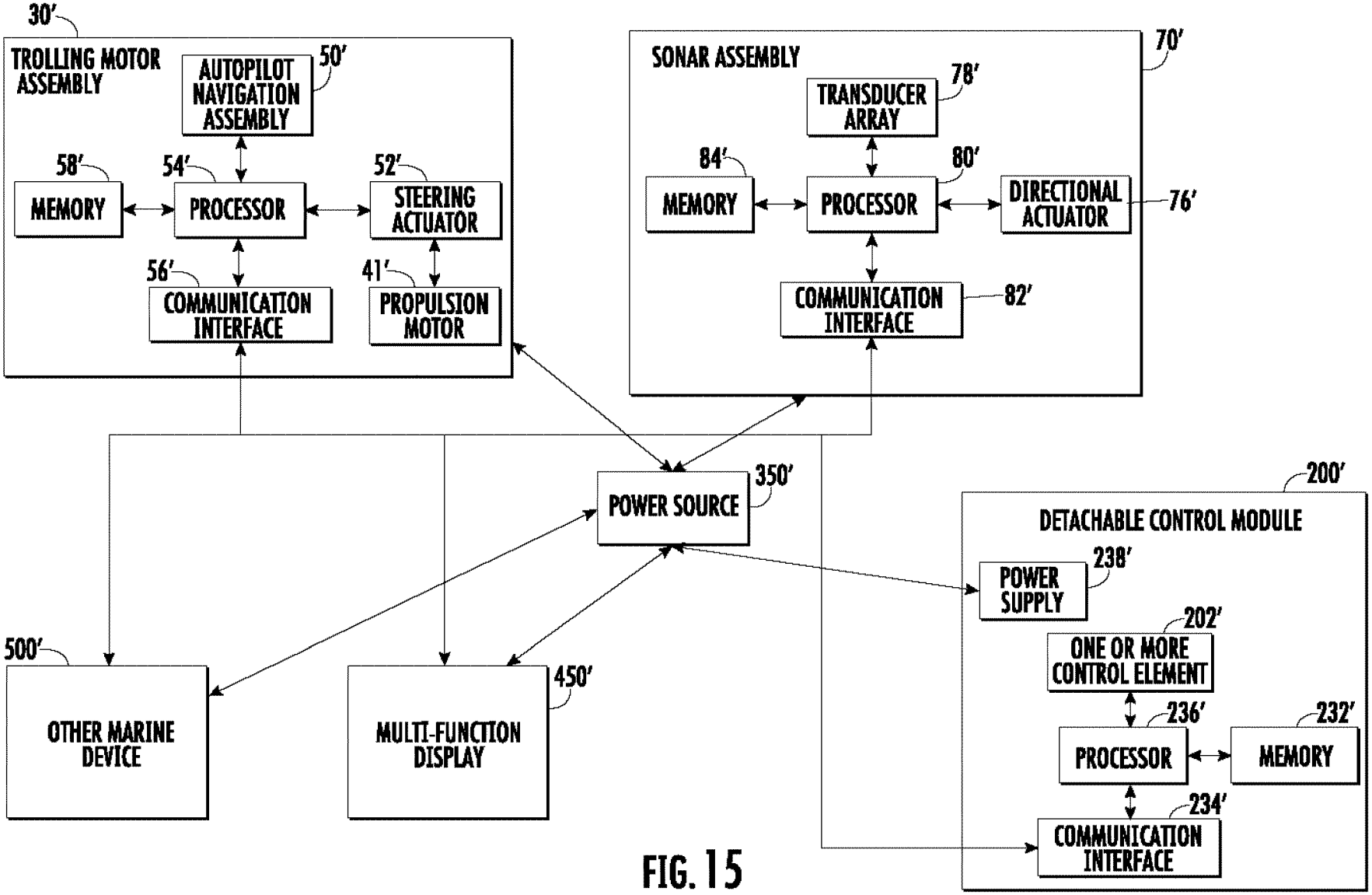
Figure 16:
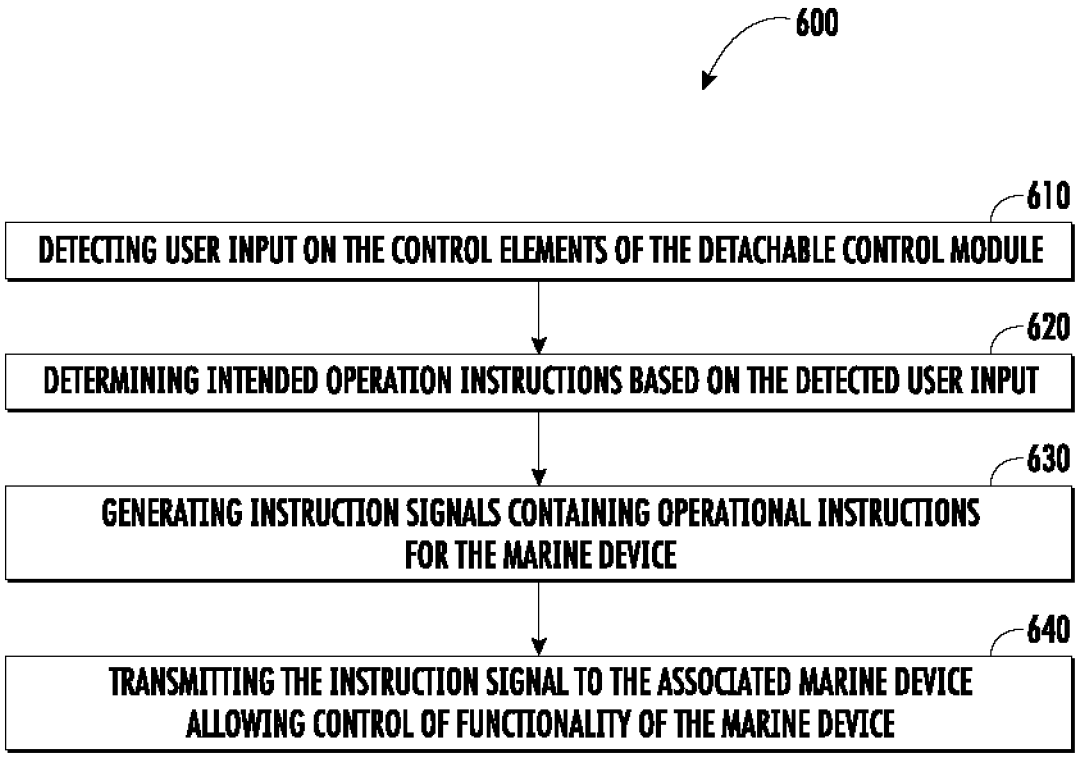

Having thus described the invention in general terms, reference will now be made to the accompanying drawings, which are not necessarily drawn to scale, and wherein:

FIG. 1 illustrates an example trolling motor assembly attached to a front of a watercraft, in accordance with some embodiments discussed herein;

FIG. 2A shows an example trolling motor assembly configured for control by a wired connection to a foot pedal assembly with a detachable control module, in accordance with some embodiments discussed herein;

FIG. 2B shows an example trolling motor assembly configured for control by a wireless connection to a foot pedal assembly with a detachable control module, in accordance with some embodiments discussed herein;

FIG. 3 shows a perspective view of an example foot pedal assembly with a detachable control module, in accordance with some embodiments discussed herein;

FIG. 4 shows a top view of the example foot pedal assembly with the detachable control module shown on FIG. 3;

FIG. 5 shows a side view of the example foot pedal assembly with the detachable control module shown in FIGS. 3 and 4;

FIG. 6 shows a perspective view of a detachable control module, in accordance with some embodiments discussed herein;

FIG. 7 shows an exploded, perspective view of a removable label positioned on top of a respective button surface of the detachable control module, in accordance with some embodiments discussed herein;

FIG. 8 shows an exploded side view of an example foot pedal assembly with a detachable control module, wherein the detachable control module is removably attached to a base portion of the foot pedal assembly;

FIG. 9 shows an exploded bottom view of the example foot pedal assembly shown in FIG. 8, wherein an attachment feature is used to removably attach the detachable control module to the base portion of the foot pedal assembly;

FIG. 10 shows a bottom view of the example foot pedal assembly with the detachable control module shown in FIG. 8 and FIG. 9;

FIG. 11 shows a perspective view of the detachable control module attaching onto an example trolling motor mount on the front of a watercraft deck, in accordance with some embodiments discussed herein;

FIGS. 12A and 12B shows an example detachable control module providing instructional signals to an example trolling motor attached to the front of a watercraft, in accordance with some example embodiments;

FIGS. 13A and 13B shows an example detachable control module providing instructional signals to an example sonar transducer assembly attached to the bow of a watercraft, in accordance with some example embodiments;

FIG. 14 shows a block diagram illustrating an example system of a foot pedal assembly with a detachable control module and trolling motor assembly, sonar assembly, multifunction display, and other marine devices, in accordance with some embodiments discussed herein;

FIG. 15 shows a block diagram illustrating an example system of a detachable control module, trolling motor assembly, sonar assembly, multifunction display, and other marine devices, in accordance with some embodiments discussed herein; and FIG. 16 shows a flowchart of an example method for controlling operation of a marine device, in accordance with some example embodiments.

DETAILED DESCRIPTION

Exemplary embodiments of the present invention now will be described more fully hereinafter with reference to the accompanying drawings, in which some, but not all embodiments of the invention are shown. Indeed, the invention may be embodied in many different forms and should not be construed as limited to the exemplary embodiments set forth herein. Rather, these embodiments are provided so that this disclosure will satisfy applicable legal requirements. Like reference numerals refer to like elements throughout.

FIG. 1 illustrates an example watercraft 10 on a body of water 15. The watercraft 10 has a trolling motor assembly 20 attached to its front, with a trolling motor 22 submerged in the body of water. The trolling motor assembly 20 represents one of various forms of marine device equipment integrated onboard the watercraft 10 which may also comprise marine devices being one of a sonar transducer assembly, a navigation system, a radar system, a marine radio device, a lighting system, an anchoring system, an autopilot system, a marine security system, or a marine power supply system. According to some example embodiments, the trolling motor assembly 20 may include a propeller 24, and a control device used to control the speed and the course or direction of propulsion. The trolling motor assembly 20 may be attached to the bow of the watercraft 10 and the propulsion motor 22 and propeller 24 may be submerged in the body of water. However, positioning of the trolling motor assembly 20 need not be limited to the bow, and may be placed elsewhere on the watercraft 10. The trolling motor assembly 20 can be used to propel the watercraft 10 under certain circumstances, such as, when fishing and/or when wanting to remain in a particular location despite the effects of wind and currents on the watercraft 10. Depending on the design, the propeller 24 of a trolling motor assembly may be driven by a gas-powered engine and/or an electric motor. Moreover, steering the trolling motor assembly 20 may be accomplished manually via hand control or via foot control. While FIG. 1 depicts the trolling motor assembly 20 as being a secondary propulsion system to the main engine 11, example embodiments described herein contemplate that the trolling motor assembly 20 may be the primary propulsion system for the watercraft 10.

FIG. 2A and FIG. 2B illustrates an example trolling motor assembly 30 that is preferably controlled by a foot pedal assembly 100 with a detachable control module 200 (e.g., an example trolling motor assembly and foot pedal assembly with a detachable control module is shown in FIG. 14). The trolling motor assembly 30 includes a shaft 32 defining a first end 34 and a second end 36, a trolling motor housing 38 and a main housing 40. The trolling motor housing 38 is attached to the second end 36 of the shaft 32 and at least partially contains a propulsion motor 41, or trolling motor, that connects to a propeller 42. As shown in FIG. 1, in some embodiments, when the trolling motor assembly is attached to the watercraft 10 and the propulsion motor 41 (or trolling motor) is submerged in the water, the propulsion motor is configured to propel the watercraft to travel along the body of water. In addition to containing the propulsion motor 41, the trolling motor housing 38 may include other components such as, for example, a sonar transducer assembly and/or other sensors or features (e.g., lights, temperature sensors, etc.).

As shown in FIG. 1, in some embodiments, when the trolling motor assembly is attached to the watercraft and the propulsion motor 41 is submerged in the water, the main housing 40 is positioned out of the body of water and visible/accessible by a user. The main housing 40 may be configured to house components of the trolling motor assembly, such as may be used for processing marine data and/or controlling operation of the trolling motor, among other things. For example, with reference to FIG. 14, depending on the configuration and features of the trolling motor assembly, the trolling motor assembly 30 may contain, for example, one or more of a processor 54, memory 58, communication interface 56, an autopilot navigation assembly 50, and a steering actuator 52 for the propulsion motor 41.

As shown in FIG. 2A, in some embodiments, the trolling motor assembly 30 includes a foot pedal assembly 100 with a detachable control module 200, that is electrically connected to the trolling motor assembly 30 using a cable 251. In some embodiments, the trolling motor assembly includes a foot pedal assembly 100 with a detachable control module 200, that is wirelessly connected to the trolling motor assembly 30 through a wireless communication 380 as shown in FIG. 2B. Referring also to FIG. 14, the foot pedal assembly 100 with the detachable control module 200 may enable a user to steer and/or otherwise operate the trolling motor assembly 30 to control the direction of the watercraft. Further, in some embodiments, the foot pedal assembly 100 with a detachable control module 200 may be connected to a sonar transducer assembly, or other marine device through a wired connection 251 or a wireless connection 380.

FIGS. 3-6 show an example implementation of a user input system of a control device according to various example embodiments in the form of a foot pedal assembly 100 with a detachable control module 200. The foot pedal assembly 100 in some embodiments may comprise a base portion 106 and a top portion 102, wherein the top portion is rotatable with respect to the base portion, and wherein the top portion further defines a top surface 104. The base portion of the foot pedal assembly further comprises a front portion 108 and an opposing back portion 110. The detachable control module 200 removably attaches to the back of the base portion 110 of the foot pedal assembly. A connecting cable 250 extends out from the module housing of the detachable control module 200 to interface with receiving contacts of the foot pedal assembly 100, facilitating a hard-wired conductive pathway, such as for delivering electrical power and/or transmitting data communications between components. The detachable control module 200 further comprises a top surface of the module housing 204 with one or more control elements 202 disposed thereon, wherein the one or more control elements comprise at least two depressible buttons and provide additional control over functionality of a corresponding marine device (e.g., the foot pedal assembly 100 and/or other marine devices, such as described herein). In some embodiments, the foot pedal assembly 100 may contain a wireless communication module enabling a wireless interface with the detachable control module 200 to allow communication between the two components. The foot pedal assembly 100 with a detachable control module 200 may be one example of a user input system that, in some embodiments, includes a switch 128 (FIG. 14), a pressure sensor 127 (FIG. 14) and/or pivotable foot pedal 105 (although in some embodiments, there may be less or more components, such as there may be no pressure sensor within the foot pedal assembly).

The foot pedal assembly 100 with the detachable control module 200 may be in operable communication with the trolling motor assembly 30, via, for example, the processor 120 as described with respect to FIG. 14. The foot pedal assembly 100 with the detachable control module 200 further includes a power supply 132, wherein the power supply 132 may receive power from a power source 350 (and/or may supply its own power, such as via a battery), and a deflection sensor 126 (FIG. 14). The deflection sensor 126 may measure the deflection of the foot pedal 105 and provide an indication of the deflection to, for example, processor 120. As detailed herein, embodiments of the present invention provide a foot pedal assembly 100 configured for remotely controlling a trolling motor assembly 30, wherein the foot pedal assembly 100 includes a detachable control module 200 that is removably attached to the foot pedal assembly 100.

The detachable control module 200 may include one or more control elements 202 which may be in the form of depressible buttons, switches, and/or other inputs. The control elements allow user interaction such that pressing a control element registers an input that is detected by internal components of the detachable control module 200. Based on which control element receives manipulation, a processor (e.g., processor 120 in FIG. 14), determines what corresponding instruction signals to generate. The instruction signal is then transmitted over communication links to a corresponding communication interface of a marine device causing intended functional responses. For example, with reference to FIG. 6, the detachable control module 200 may include one or more control elements 202, where in the illustrated embodiment includes a first, left button 202*a*, a second, middle button 202*b*, and third, right button 202*c* (although any number of buttons or any type of user input (e.g., dial, touch screen, sensor, etc.) may be utilized). In an example embodiment, a user pressing the leftmost control button 202*a* may cause the processor 120 to transmit instructional signals to a communication interface of a corresponding marine device causing intended functional response(s). The user pressing the rightmost control button 202*c* may cause the processor 120 to transmit alternative instruction signals to the communication interface of the corresponding marine device causing intended functional response(s). Additionally, the user pressing the middle control button 202*b* may cause the processor 120 to transmit alternative instruction signals to the communication interface of the corresponding marine device causing intended functional response(s). Thereby, each provided manipulatable control element presented in the example embodiment allow for a plurality of functional control options when registering user input.

In another example embodiment, the detachable control module 200 may be connected to a foot pedal assembly 100, wherein the foot pedal assembly 100 with the detachable control module 200 may be in operable communication with a marine device such as a trolling motor assembly 30. The detachable control module 200 may include one or more control elements 202 wherein the one or more control elements 202 comprise at least two depressible buttons that allow user interaction such that pressing a control element registers an input that is detected by internal components of the detachable control module 200 and transmitted to a corresponding marine device. A user may press one or more control elements 202 of the detachable control module 200 and, based on which control element is pressed, a processor 120 determines what corresponding instruction signals to generate. The instruction signal is then transmitted over communication links (e.g., wired or wireless connection) to a communication interface of the corresponding marine device causing intended operational control of the corresponding marine device. For an example, a foot pedal assembly 100 with the detachable control module 200 can control the operational functions of the trolling motor assembly 30 based on which control element receives manipulation of the detachable control module 200. For example, the processor 120 determines an instruction signal to generate based on the registered user input on the one or more control element 202 of the detachable control module 200, wherein the instruction signal is transmitted to the communication interface 56 of the trolling motor assembly 30. The instruction signal transmitted may be, for example, an indication of a rate of rotation for a propulsion motor 41 of the trolling motor assembly 30 to steer the propulsion motor 41 in a preferred direction that may be ultimately provided to the steering actuator 52 of the trolling motor assembly 30 (FIG. 14). The instructional input signal may be communicated between the foot pedal assembly 100 with the detachable control module 200 and the trolling motor 41 via a wired or wireless connection. While the configurations described herein illustrate the one or more control elements 202 being configured to control a trolling motor assembly, the one or more control elements may also be programmed to a myriad of functional control operations to the trolling motor assembly (e.g., speed control, steering/directionality, motor controls, etc.). In some embodiments, a user may customize what functionality is controlled by the corresponding control elements on the detachable control module 200. As such, the one or more control element 202 are further user-programmable to customize the control over functionality related to the marine device. Notably, while the example embodiments described above utilize a foot pedal assembly with a detachable control module in operable communication with a trolling motor assembly, some embodiments of the present invention contemplate use with other systems/structures, such as a sonar assembly 70, multifunction display 450, or other marine devices 500 (FIG. 14). Accordingly, the control elements on the detachable control module 200 may cause corresponding functionality on any marine device (including providing functional control of different marine devices even among different control elements on the same detachable control module).

As introduced in FIG. 6, the detachable control module 200 may include one or more control elements 202 wherein the one or more control elements 202 comprise at least two depressible buttons that allow user interaction. While the earlier configurations above described the one or more control elements 202 being configured to control a corresponding marine device such as a trolling motor, the one or more control elements may be customizable to be programmed to a myriad of functional control operations to any marine device. As such, the one or more control elements 202 may be designed to receive intuitive indicators to assist users accurately comprehending associated functionalities triggered when depressing the one or more control element 202. FIG. 7 illustrates an example intuitive indicator to assist users accurately comprehending associated functionalities triggered when depressing the one or more control element 202, shown as a removable label 208. The removable label 208 is positioned on top of the respective user-programmable button surface 206, wherein the removable label 208 provides an indication of assigned functionality for the corresponding button. A user may denote functionality relevant to a marine device wherein the one or more control elements 202, may be programmed to control a specific function of the marine device wherein the user may denote the removable label 208 with a control operational icon to illustrate the corresponding control operation in which the one or more control element 202 is programmed for. In some embodiments, a user may denote functionality relevant to marine devices, such as a trolling motor, wherein the one or more control elements 202 may be programmed to control direction of the trolling motor wherein the user may denote the removable label 208 with a directional arrow icon to illustrate the corresponding direction in which the one or more control element 202 is programmed for.

In another example embodiment, a user may denote functionality relevant to a marine device, such as a sonar assembly, wherein the one or more control elements 202 may be programmed to control adjustment of the beam-direction angle of a sonar transducer of the sonar assembly wherein the user may denote the removable label 208 with a directional sonar icon to illustrate the corresponding beam-direction angle adjustment in which the one or more control elements 202 is programmed for. The removable label 208 reflects corresponding assignments without limiting possibilities across the breadth of integrable marine devices. Further, while the example embodiments utilize a trolling motor and sonar assembly, some embodiments of the present invention contemplate use with other marine device and for other functionality.

Referring now to FIG. 8, the detachable control module 200 contains attachment features 209 wherein the detachable control module 200 may be removably attached with attachment features 109 of another marine device using the attachment features 209 to securely fasten the detachable control module 200 to the marine device (e.g., the foot pedal assembly 100) and enable removeable separation afterward. In this embodiment, FIG. 8 illustrates the detachable control module 200 removably attaching to the back of the base portion 110 of foot pedal assembly 100 as mentioned earlier. The detachable control module 200 initially attaches with a downward vertical motion positioning the detachable control module 200 onto the receiving cavity (e.g., attachment features 109) of the back of the base portion 110 of the foot pedal assembly wherein using attachment features securely fastens the detachable control module 200 to the back of the base portion 110 of the foot pedal assembly 100. While the example embodiment utilizes a foot pedal assembly, some embodiments of the detachable control module can be shown removably attached with other marine devices using attachment features to securely fasten the detachable control module 200 to the marine device and enable removeable separation afterward.

FIG. 9 and FIG. 10 further illustrate connection interfaces that allow the detachable control module to securely fasten to a foot pedal assembly 100 and enable removeable separation afterward. This is shown with an attachment feature 210 in the form of a removable plate, such plate providing removable attachment to secure the detachable control module 200 to the back of the base portion 110 of foot pedal assembly 100. While the example embodiment utilizes a foot pedal assembly, some embodiments of the present invention can be shown removably attached with other marine devices using attachment features to securely fasten the detachable control module 200 to the marine device and enable removeable separation afterward.

As described in FIG. 9 and FIG. 10, in another embodiment, FIG. 11 illustrates the detachable control module 200, and a marine device such as a trolling motor 20. The detachable control module 200 is removably attached using attachment features to securely fasten the detachable control module 200 directly onto a trolling motor mount 46 of the trolling motor 20 that is secured aboard a watercraft. Further, while the example embodiment utilizes the detachable control module removably attaching onto a trolling motor mount of a trolling motor, some embodiments of the detachable control module 200 contemplate use with other marine devices utilizing the attachment features to securely fasten the detachable control module 200 to the marine device and enable removeable separation afterward showing the detachable control module containing the ability to removably attach universally to other marine devices.

Moving on to FIGS. 12A and 12B, is an example embodiment wherein a detachable control module 200' (FIG. 15) may be configured to function as an independent system that is in operable communication with a marine device. The detachable control module 200' comprises a module housing that may include one or more control elements 202' which may be in the form of depressible buttons, switches, or other inputs. The control elements allow user interaction such that pressing a control element registers input that is detected by internal components of the detachable control module 200'. Based on which control element receives manipulation, a processor 236', determines what corresponding instruction signals to generate. The instruction signal is then transmitted over communication links to a corresponding communication interface of a marine device causing intended functional response(s).

With reference to FIGS. 12A and 12B, an example embodiment shows the detachable control module 200' in operable communication with a marine device such as a trolling motor assembly 30'. The detachable control module 200' may include one or more control elements 202', wherein the illustrated embodiment includes a first, left button 202*a*', a second, middle button 202*b*', and third, right button 202*c*' (although any number of buttons or any type of user input (e.g., dial, touch screen, sensor, etc.) may be utilized). In this regard, a user 12' pressing the first, left button 202*a*' causes a wireless communication 380 between the communication interface 234' of the detachable control module 200' to transmit instruction signal(s) to the communication interface 56' of the trolling motor assembly 30'. The instruction signal transmitted may be, for example, an indication of a rate of rotation for a propulsion motor 41' of the trolling motor assembly 30' to steer the propulsion motor 41' of the trolling motor assembly in a leftward direction by the steering actuator 52', wherein pressing the third, right button 202*c*' causes a wireless communication between the communication interface 234' of the detachable control module to transmit instruction signal(s) the communication interface 56' of the trolling motor assembly 30'. The instruction signal transmitted may be, for example, an indication of a rate of rotation for a propulsion motor 41' of the trolling motor assembly 30' to steer the propulsion motor 41' of the trolling motor assembly in a rightward direction by the steering actuator 52', wherein pressing the second, middle button 202*b*' causes a wireless communication between the communication interface 234' of the detachable control module to transmit instruction signals to the communication interface 56' of the trolling motor assembly 30'. The instruction signal transmitted may be an indication to power ON/OFF the propulsion motor 41' of the trolling motor assembly 30'.

While the configurations described herein illustrate the one or more control elements 202' being configured to control a trolling motor assembly, the one or more control elements 202' may also be customizable to be programmed to myriad of functional control operations to the trolling motor assembly (e.g., speed control, steering/directionality, motor controls, etc.). As such, the one or more control elements 202' with a myriad of user-programmable control operations, may receive intuitive indicators to assist users accurately comprehending associated functionalities triggered when, for example, depressing the one or more control element 202'. As such, a user 12' may install a label, such as by placing the label atop of the respective user-programmable control element wherein the user 12', which may illustrate the corresponding control operation in which the one or more control element 202' is programmed for. As such, the one or more control element 202' are further user-programmable to customize the control over functionality related to the marine device. Further, while the above example embodiment details a wireless communication between the detachable control module 200' and trolling motor assembly 30', in some embodiments, a wired communication may be formed in transmitting instruction signals to a corresponding marine device.

FIGS. 13A and 13B illustrate another example embodiment wherein a detachable control module 200' (FIG. 15) may be configured to function as an independent system that is in operable communication with a marine device. The detachable control module 200' comprises a module housing that may include one or more control elements 202' which may be in the form of depressible buttons, switches, or other inputs. The control elements allow user interaction such that pressing a control element registers an input that is detected by internal components of the detachable control module 200'. Based on which control element receives manipulation, a processor 236' determines what corresponding instruction signal(s) to generate. The instruction signal is then transmitted over communication links to a corresponding communication interface of a marine device causing intended functional responses. With reference to FIGS. 13A and 13B, an example embodiment shows the detachable control module 200' in operable communication with a marine device such as a sonar assembly 70'. The detachable control module 200' may include one or more control elements 202', wherein the illustrated embodiment includes a first, left button 202*a*', a second, middle button 202*b*', and third, right button 202*c*' (although any number of buttons or any type of user input (e.g., dial, touch screen, sensor, etc.) may be utilized). In this regard, a user 12' pressing the first, left button 202*a*' causes a wireless communication 380 between the communication interface 234' of the detachable control module 200' to transmit instruction signal(s) to the communication interface 82' of the sonar assembly 70'. The instruction signal transmitted may be an indication of an adjustment for a sonar transducer assembly 72' of the sonar assembly 70' to adjust a beam-direction angle of the sonar transducer assembly 72' by the directional actuator 76' in a leftward direction, wherein pressing the second, right button 202*c*' causes a wireless communication 380 between the communication interface 234' of the detachable control module 200' to transmit instruction signal(s) to the communication interface 82' of the sonar assembly 70'. The instruction signal transmitted may be an indication of an adjustment for a sonar transducer assembly 72' of the sonar assembly 70' to adjust the beam-direction angle of the sonar transducer assembly 72' by the directional actuator 76' in a rightward direction, wherein pressing the second, middle button 202*b*' causes the communication between the communication interface 234' of the detachable control module to transmit instruction signal(s) to the communication interface 82' of the sonar assembly 70'. The instruction signal transmitted may be an indication to power ON/OFF the sonar assembly 70'.

While the configurations described herein illustrate the one or more control elements 202' being configured to control a sonar assembly, the one or more control elements 202' may also be customizable to be programmed to a myriad of different functional control operations to the sonar assembly (e.g., traducer control, beamforming controls, imaging mode control, frequency control etc.).

Further, while the above example embodiments shown in FIGS. 12A and 12B, utilize a trolling motor 30', and FIGS. 13A and 13B utilize a sonar assembly 70', some embodiments of the detachable control module contemplate use with other systems/structures, such as a multifunction display 450', or other marine devices 500' (FIG. 15).

Example System Architecture

FIG. 14 shows a block diagram of a foot pedal assembly 100 with a detachable control module 200 in communication with a trolling motor assembly 30, sonar assembly 70, multifunction display 450, and other marine devices 500. As described herein, it is contemplated that while certain components and functionalities of components may be shown and described as being part of the foot pedal assembly 100 with a detachable control module 200, trolling motor assembly 30, sonar assembly 70, multifunction display 450, and other marine devices 500, according to some example embodiments, some components (e.g., the autopilot navigation assembly 50, portions of the sonar assembly 70, functionalities of the processors 54, 80, and 120, or the like) may be included in the other of the foot pedal assembly 100 with a detachable control module 200, trolling motor assembly 30, sonar assembly 70, multifunction display 450, and other marine devices 500.

As depicted in FIG. 14, the foot pedal assembly 100 with the detachable control module 200 may include a processor 120, a communication interface 122, a memory 124, a deflection sensor 126, a switch 128, a pressure sensor 127, a foot pedal 130, a power supply 132 and a one or more control element 202.

The processor 120 may be any means configured to execute various programmed operations or instructions stored in a memory device such as a device or circuitry operating in accordance with software or otherwise embodied in hardware or a combination of hardware and software (e.g., a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the processor 120 as described herein. In this regard, the processor 120 may be configured to analyze signals from the one or more control elements 202 and signals from the deflection sensor 126, the switch 128, the pressure sensor 127, and the foot pedal 105 and convey the signals or variants of the signals, via the communication interface 122 to permit the trolling motor assembly 30, the sonar assembly 70, the multifunction display 450, and the other marine devices 500 to operate accordingly.

The memory 124 may be configured to store instructions, computer program code, operational codes and instructions, marine data (such as sonar data, chart data, location/position data), and other data in a non-transitory computer readable medium for use, such as by the processor 120.

The communication interface 122 may be configured to enable connection to external systems (e.g., communication interface 56, 82, a multifunction display, other marine devices, etc.). In this manner, the processor 122 may retrieve stored data from a remote, external server via the communication interface 122 in addition to or as an alternative to the memory 124.

Communication interfaces 122, 56, and 82 may be configured to communicate via a number of different communication protocols and layers. For example, the link between the communication interface 122 and communication interface 56 any type of wired or wireless communication link. For example, communications between the interfaces may be conducted via Bluetooth, Ethernet, the NMEA 2000 framework, cellular, WiFi, or other suitable networks.

Various example embodiments of a foot pedal assembly 100 with a detachable control module 200 may be utilized to detect the user activity and facilitate generation of instructional input signals. To do so, various sensors including feedback sensors, and mechanical devices that interface with the sensors, may be utilized. For example, a deflection sensor 126 and a pressure sensor 127 may be utilized as sensors to detect user activity. Further, the foot pedal 105 and one or more control element 202 may be mechanical devices that are operably coupled to the sensors and may interface directly with a user to facilitate inputting, for example, a rate of turn by the user via the foot pedal assembly 100 with the detachable control module 200.

FIG. 15 shows a block diagram of a detachable control module 200' in communication with a trolling motor assembly 30', sonar assembly 70', multifunction display 450', and other marine devices 500'. As described herein, it is contemplated that while certain components and functionalities of components may be shown and described as being part of the detachable control module 200', trolling motor assembly 30', sonar assembly 70', multifunction display 450', and other marine devices 500' according to some example embodiments, some components (e.g., the autopilot navigation assembly 50', portions of the sonar assembly 70', functionalities of the processors 54', 80', and 236', or the like) may be included in the other detachable control module 200', trolling motor assembly 30', sonar assembly 70', multifunction display 450', and other marine devices 500'.

As depicted in FIG. 15, the detachable control module 200' may include a processor 236', a communication interface 234', a memory 232', a power supply 238' and a one or more control element 202' wherein the detachable control module does not rely on external systems for operation. The detachable control module achieves standalone functionality to simplify functional control to corresponding marine devices. Notably, housing the listed components internally with a power supply 238' enables the detachable control module sustained functionality. In some embodiments, the power supply 238' may receive power through an external power source 350' allowing flexible sustainment. The processor 236' determines what corresponding operational instruction signals to generate based on user input on the one or more control elements 202'. The instruction signal is then transmitted over communication links from the communication interface 234' to a corresponding communication interface of a marine device (e.g., 56', 82' a multifunction display, other marine devices, etc.) wherein the communication interface 234' allows operational communication between the detachable control module and a corresponding marine device through a wired or wireless connection. Housing such components internally allows the detachable control module improved flexibility and versatility and to improve operational control of marine devices onboard watercrafts.

The processor 236' may be any means configured to execute various programmed operations or instructions stored in a memory device such as a device or circuitry operating in accordance with software or otherwise embodied in hardware or a combination of hardware and software (e.g., a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the processor 236' as described herein. In this regard, the processor 236' may be configured to analyze signals from the one or more control elements 202' and convey the signals or variants of the signals, via the communication interface 234' to permit the trolling motor assembly 30', the sonar assembly 70', the multifunction display 450', and the other marine devices 500' to operate accordingly.

The memory 232' may be configured to store instructions, computer program code, operational codes and instructions, marine data (such as sonar data, chart data, location/position data), and other data in a non-transitory computer readable medium for use, such as by the processor 236'.

The communication interface 234' may be configured to enable connection to external systems (e.g., communication interface 56', 82', a multifunction display, other marine devices, etc.). In this manner, the processor 236' may retrieve stored data from a remote, external server via the communication interface 234' in addition to or as an alternative to the memory 232'.

Communication interfaces 234', 56', and 82' may be configured to communicate via a number of different communication protocols and layers. For example, the link between the communication interface 234' and communication interface 56' any type of wired or wireless communication link. For example, communications between the interfaces may be conducted via Bluetooth, Ethernet, the NMEA 2000 framework, cellular, WiFi, or other suitable networks.

Various example embodiments of a detachable control module 200' may be utilized to detect the user activity and facilitate generation of instructional input signals. To do so, and mechanical devices that interface with the processor may be utilized. For example, the one or more control element 202' may be mechanical devices that interface directly with a user to facilitate inputting, for example, a rate of turn by the user via the detachable control module 200'.

Example Flowchart(s) and Operation

FIG. 16 illustrates a flowchart according to an example method for controlling operation of a marine device with a detachable control module according to an example embodiment 600 wherein various operations that may, for example, be performed by, with the assistance of, or under the control of one or more of the processor 54, 54', 80, 80', 120, or 236', or with other associated components described with respect to FIG. 14 or 15 or otherwise herein and these components may therefore constitute means for performing the respective operations. In this regard, the example method may include detecting user input at a detachable control module at 610. At 620, the example method may include determining operation instructions based on the user input. At 630, the example method may include generating an operational instruction signal to a marine device such as one of a trolling motor assembly, sonar assembly, a propulsor, a marine electronic device, a marine navigation system, a radar system, a marine radio, boat lighting, a fishing equipment controller, a marine security system, an anchor system, an autopilot system, or a marine power supply. The example method may include, at 640, transmitting the instruction signal to the corresponding marine device causing functional control.

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A user input system for controlling operation of a marine device, the user input system comprising:

a foot pedal assembly for controlling one or more operations of at least one of a trolling motor assembly or a sonar assembly, wherein the trolling motor assembly comprises a trolling motor, wherein the sonar assembly comprises a sonar transducer assembly, wherein the foot pedal assembly comprises a base portion and a top portion, wherein the top portion is rotatable with respect to the base portion so as to enable a user to provide user input for steering a facing direction of the trolling motor or the sonar transducer assembly, wherein the top portion defines a top surface that is configured to receive a user's foot thereon;

a detachable control module configured to removably attach to the base portion of the foot pedal assembly for controlling operation of the marine device, wherein the marine device comprises one of the trolling motor assembly, the sonar assembly, a propulsor, a marine electronic device, a marine navigation system, a radar system, a marine radio, boat lighting, a fishing equipment controller, a marine security system, an anchor system, an autopilot system, or a marine power supply, the detachable control module comprising:

a module housing having a plurality of control elements disposed thereon, wherein the plurality of control elements provide additional control over functionality of the marine device through instruction signals sent over an established wired or wireless connection; and one or more attachment features disposed on the module housing to removably attach the detachable control module to corresponding one or more foot pedal attachment features on the base portion; and a processor, wherein the processor is configured to:

receive, based on user input being provided to at least one of the plurality of control elements, a signal indicative of the user input;

determine, based on at least one of the user input or the plurality of control elements to which the user input was provided, a corresponding marine device and a corresponding instruction signal to send to the corresponding marine device; and cause transmission of the instruction signal to the corresponding marine device via the wired or wireless connection to cause the corresponding marine device to perform functionality associated with the at least one of the plurality of control elements to which the user input was provided.

2. The user input system of claim 1, wherein the base portion of the foot pedal assembly comprises a front and an opposing back, wherein the one or more foot pedal attachment features are positioned on or near the back of the base portion such that the detachable control module removably attaches to the back of the base portion.

3. The user input system of claim 1, wherein a cable extends from the module housing of the detachable control module and is configured to electrically connect to an interface of the base portion of the foot pedal assembly to establish a module-to-foot pedal assembly wired connection to allow transmission of instruction signals to the foot pedal assembly.

4. The user input system of claim 3, wherein the foot pedal assembly is configured to provide power to the detachable control module via the module-to-foot pedal assembly wired connection.

5. The user input system of claim 1, wherein the foot pedal assembly comprises a wireless communication module that establishes a wireless communication interface, wherein the processor is positioned within the detachable control module, and wherein the processor of the detachable control module is configured to wirelessly transmit the instruction signals to the wireless communication module of the foot pedal assembly for communication to the corresponding marine device therefrom.

6. The user input system of claim 1 wherein the plurality of control elements comprises a first control element and a second control element, wherein the first control element is positioned proximate a left side of the detachable control module and the second control element is positioned proximate a right side of the detachable control module, wherein pressing the first control element causes the processor of the detachable control module to transmit instruction signals to the trolling motor assembly to steer the trolling motor of the trolling motor assembly in a leftward direction, wherein pressing the second control element causes the processor of the detachable control module to transmit instruction signals to the trolling motor assembly to steer the trolling motor of the trolling motor assembly in a rightward direction.

7. The user input system of claim 1, wherein the plurality of control elements comprises a first control element and a second control element, wherein the first control element is positioned proximate a left side of the detachable control module and the second control element is positioned proximate a right side of the detachable control module, wherein pressing the first control element causes the processor of the detachable control module to transmit instruction signals to the sonar assembly to adjust a beam-direction angle of the sonar transducer assembly in a leftward direction, wherein pressing the second control element causes the processor of the detachable control module to transmit instruction signals to the sonar assembly to adjust the beam-direction angle of the sonar transducer assembly in a rightward direction.

8. The user input system of claim 1, wherein the plurality of control elements comprise at least two buttons positioned on the module housing and facing upwardly therefrom.

9. The user input system of claim 8, wherein each of the at least two buttons is user-programmable to customize control over functionality related to the marine device.

10. The user input system of claim 9, wherein the at least two user-programmable buttons further comprise a removable label positioned on top of the respective user-programmable button surface, wherein the removable label provides an indication of assigned functionality for the corresponding button.

11. A detachable control module for controlling operation of a marine device, the detachable control module comprising:

a module housing;

a battery disposed within the module housing and configured to provide operating power to the detachable control module;

a top portion defining a top surface;

a plurality of control elements disposed on the top surface of the module housing, wherein the plurality of control elements provide additional control over functionality of the marine device through instruction signals sent over an established wired or wireless connection;

one or more attachment features disposed on the module housing to removably attach the detachable control module; and a processor, wherein the processor is configured to:

receive, based on user input being provided to at least one of the plurality of control elements, a signal indicative of the user input;

determine, based on at least one of the user input or the plurality of control elements to which the user input was provided, a corresponding marine device and a corresponding instruction signal to send to the corresponding marine device; and cause transmission of the instruction signal to the corresponding marine device via the wired or wireless connection to cause the corresponding marine device to perform functionality associated with the at least one of the plurality of control elements to which the user input was provided.

12. The detachable control module of claim 11, wherein the battery comprises a rechargeable battery.

13. The detachable control module of claim 11, wherein the one or more attachment features on the detachable control module housing enable removable attachment of the detachable control module onto an existing trolling motor mounting assembly to provide additional user control input capabilities.

14. The detachable control module of claim 11, wherein the plurality of control elements comprise at least two buttons positioned on the top surface of the module housing and facing upwardly therefrom.

15. The detachable control module of claim 14, wherein each of the at least two buttons is user-programmable to customize the control over functionality related to the marine device.

16. The detachable control module of claim 15, wherein the at least two user-programmable buttons further comprise a removable label positioned on top of the respective user-programmable button surface, wherein the removable label provides an indication of assigned functionality for the corresponding button.

17. The detachable control module of claim 11, wherein the processor is further configured to interface with any marine device or system that can receive instruction signals and initiate instructed operations.

18. A method for controlling operation of a marine device with a detachable control module, the method comprising:

detecting user input provided to at least one of a plurality of control elements of the detachable control module, wherein the user input indicates a desire of the user to control operation of the marine device, wherein the detachable control module comprises one or more attachment features disposed on a module housing of the detachable control module to removably attach the detachable control module, and wherein the detachable control module comprises a battery disposed within the module housing and configured to provide operating power to the detachable control module;

determining intended operation instructions based on the detected user input;

generating by a processor in communication with the plurality of control elements, instruction signals containing operational instructions for the marine device based on the determined user input;

transmitting the generated instruction signal to the associated marine device via a wired or wireless connection between the detachable control module and the marine device; and controlling functionality of the marine device by the executed selected operations based on the transmitted instruction signal for the marine device.

19. The method of claim 18, wherein the plurality of control elements comprise at least two buttons that are user-programmable to customize the control over functionality related to the marine device.

20. The method of claim 19, wherein the at least two user-programmable buttons further comprise a removable label positioned on top of the respective user-programmable button surface, wherein the removable label provides an indication of assigned functionality for the corresponding button.

* * * * *